US011062727B2

(12) United States Patent
Shahen Tov et al.

(10) Patent No.: US 11,062,727 B2
(45) Date of Patent: Jul. 13, 2021

(54) SYSTEM AND METHOD FOR VOICE ACTIVITY DETECTION

(71) Applicant: Ceva D.S.P. Ltd., Herzlia Pituach (IL)

(72) Inventors: Ofer Shahen Tov, Ra'anana (IL); Ofer Schwartz, Petah Tikvah (IL); Aviv David, Hod-Hasharon (IL)

(73) Assignee: CEVA D.S.P LTD., Herzlia Pituach (IL)

( * ) Notice: Subject to any disclaimer, the term of this patent is extended or adjusted under 35 U.S.C. 154(b) by 75 days.

(21) Appl. No.: 16/435,656

(22) Filed: Jun. 10, 2019

(65) Prior Publication Data

US 2019/0385635 A1 Dec. 19, 2019

Related U.S. Application Data

(60) Provisional application No. 62/684,357, filed on Jun. 13, 2018, provisional application No. 62/774,879, filed on Dec. 4, 2018.

(51) Int. Cl.
*G10L 25/78* (2013.01)
*G10L 25/21* (2013.01)

(52) U.S. Cl.
CPC ..... *G10L 25/78* (2013.01); *G10L 25/21* (2013.01); *G10L 2025/786* (2013.01)

(58) Field of Classification Search
None
See application file for complete search history.

(56) References Cited

U.S. PATENT DOCUMENTS 9,866,952 B2 1/2018 Pandey et al.
2010/0266137 A1* 10/2010 Sibbald ..... G10K 11/17885 381/71.6
2010/0280827 A1* 11/2010 Mukerjee ..... G10L 15/197 704/236
2016/0300584 A1* 10/2016 Pandey ..... H04R 29/007
(Continued)

FOREIGN PATENT DOCUMENTS

JP 2016050872 4/2016

OTHER PUBLICATIONS

Beritelli et al., "A multichannel speech/silence detector based on time delay estimation and fuzzy classification," in Proceedings of the IEEE International Conference on Acoustics, Speech, and Signal Processing, vol. 1, pp. 93-96, 1999.
(Continued)

*Primary Examiner* — Quynh H Nguyen
(74) *Attorney, Agent, or Firm* — Pearl Cohen Zedek Latzer Baratz LLP

(57) ABSTRACT

In a system and method for voice activity detection (VAD) including: obtaining audio frames from a multi-microphone array; calculating steered response power (SRP) values of the audio frames; calculating entropy levels based on the SRP values; detecting a sequence of audio frames in which the entropy levels are substantially constant across the sequence of frames and denoting an entropy level of the sequence as a background entropy; identifying an incoming audio frame as containing voice activity if the difference between a level of entropy of the current audio frame and the background entropy is larger than a first threshold, and as not containing voice activity otherwise.

17 Claims, 14 Drawing Sheets

(56) References Cited

U.S. PATENT DOCUMENTS

2017/0034026 A1* 2/2017 Li ..... H04L 65/80

OTHER PUBLICATIONS

Dam et al., "Blind Speech Separation Using SRP-PHAT Localization and Optimal Beamformer in Two-Speaker Environments," World Academy of Science, Engineering and Technology, International Journal of Computer and Information Engineering, vol. 10, No. 8, pp. 1529-1533, 2016.

Das H. et al., "Human Voice Localization in Noisy Environment by SRP-PHAT and MFCC," International Research Journal of Advanced Engineering and Science, vol. 1, No. 3, pp. 33-37, 2016.

Hioka et al., "Voice activity detection with array signal processing in the wavelet domain," IEICE transactions on fundamentals of electronics, communications and computer sciences, vol. 86, No. 11, pp. 2802-2811, 2003.

Hoffman et al., "Gsc-based spatial voice activity detection for enhanced speech coding in the presence of competing speech," IEEE Transactions on speech and audio processing, vol. 9, No. 2, pp. 175-178, 2001.

Hummes et al., "Robust Acoustic Speaker Localization with Distributed Microphones," 19th European Signal Processing Conference (EUSIPCO 2011), Barcelona, Spain, 2011.

Kim et al., "Voice activity detection using phase vector in microphone array," Electronics Letters, vol. 43, No. 14, 2007.

Kinnunen et al., "Voice activity detection using mfcc features and support vector machine," in Int. Conf. on Speech and Computer (SPECOM07), Moscow, Russia, vol. 2, pp. 556-561, 2007.

Lim et al., "Speaker Localization in Noisy Environments Using Steered Response Voice Power," IEEE Transactions on Consumer Electronics, vol. 61, No. 1, pp. 112-118, 2015.

Potamitis, Ilyas, "Estimation of speech presence probability in the field of microphone array," IEEE Signal Processing Letters, vol. 11, No. 12, pp. 956-959, 2004.

Ramirez et al., "Voice activity detection. fundamentals and speech recognition system robustness," in Robust speech recognition and understanding. InTech, 2007.

Schwartz et al., "Multi-microphone speech dereverberation and noise reduction using relative early transfer functions," IEEE/ACM Transactions on Audio, Speech and Language Processing, vol. 23, No. 2, pp. 240-251, 2015.

Schwartz et al., "Source separation, dereverberation and noise reduction using lcmv beamformer and postfilter," in International Conference on Latent Variable Analysis and Signal Separation. Springer, pp. 182-191, 2017.

Stenzel et al., "Time-frequency dependent multichannel voice activity detection," in Proceedings of Speech Communication; 11. ITG Symposium;. VDE, pp. 1-4, 2014.

Taghizadeh et al., "An Integrated Framework for Multi-Channel Multi-Source Localization and Voice Activity Detection", IEEE Joint Workshop on Hands-free Speech Communication and Microphone Arrays (HSCMA), 2011, pp. 92-97.

J. DiBiase, H. Silverman, and M. Brandstein, "Post-filtering techniques," in Microphone Arrays. Berlin Heidelberg: Springer, 2001, pp. 157-180.

* cited by examiner

SYSTEM AND METHOD FOR VOICE ACTIVITY DETECTION

CROSS-REFERENCE TO RELATED APPLICATIONS

This application claims the benefit of U.S. Provisional Application Ser. No. 62/684,357, filed Jun. 13, 2018, and of U.S. Provisional Application Ser. No. 62/774,879, filed Dec. 4, 2018, both of which are hereby incorporated by reference in their entirety.

FIELD OF THE INVENTION

Embodiments of the invention relate to performing voice activity detection (VAD). In particular, embodiments of the invention relate to performing voice activity detection based on steered response power (SRP) values.

BACKGROUND OF THE INVENTION

State of the art smart home devices may use speech technology to enable users to control devices using their voice. Speech technology may include speech recognition and text-to-speech functionalities. These devices may need to operate well even in the presence of ambient noise, reverberation, acoustic echoes, and other disturbances. Typical speech recognition systems may use multi-microphone input and may enhance speech, suppress noise, remove echo and detect a direction of arrival (DOA) of the speaker. Noise cancellation typically requires identification of audio segments that do not contain speech and extracting noise characteristics from these segments. The extracted noise characteristics may than be used for noise cancellation.

A commonly-used solution to enhance speech is the minimum variance distortionless response (MVDR) beamformer (BF), which requires the direction of arrival (DOA) of the speaker and of the noise spatial characteristics (e.g., the power spectral density (PSD) matrix).

Two main relevant techniques can be used: SRP to estimate the speaker DOA and VAD to detect speech absence segments and estimate the noise PSD matrix. These two techniques usually act independently and have typical limitations.

VAD, also referred to as speech activity detection or speech detection, is a technique used to determine presence or absence of human speech in audio samples. Typical VAD techniques include extracting features from the speech signal, making binary decision regarding the presence or absence of speech, and smoothing the decisions along the time axis. The features may include the energy of the signal in each frequency, the periodicity of the signal in the frequency domain, the spectrum coefficients, etc.

Energy based VAD takes the energy of the signal as a feature. Usually, only the energy in speech frequencies is considered. The main drawback of energy based VAD is its low performance in low signal-to-noise ratio (SNR) cases. In high and intermediate SNR cases the energy based VAD performs well regardless of the directionality of the noise.

SUMMARY

According to embodiments of the invention, there is provided a system and method for voice activity detection (VAD). Embodiments of the invention may include: obtaining audio frames from a multi-microphone array; calculating SRP values of the audio frames; calculating entropy levels of the SRP values; and determining whether an incoming audio frame contains voice activity based on the entropy levels.

According to embodiments of the invention, there is provided a system and method for speech recognition. Embodiments of the invention may include: obtaining audio frames sampled by a multi-microphone array; providing a vector of SRP values based on the audio frames, where each SRP value provides a probability of a speaker to be in a direction associated with the SRP value; calculating instantaneous entropy levels of the SRP values; and performing voice activity detection (VAD) of the audio frames based on the entropy levels.

According to some embodiments, determining whether an incoming audio frame contains voice activity may include: detecting a sequence of audio frames in which the entropy levels are substantially constant across the sequence of frames and denoting an entropy level of the sequence as a background entropy; and identifying an incoming audio frame as containing voice activity if the difference between a level of entropy of the incoming audio frame and the background entropy is larger than a first threshold, and as not containing voice activity otherwise.

According to some embodiments, detecting the sequence of audio frames in which entropy levels are substantially constant may include: for an incoming audio frame: finding a local minimum entropy level of the audio frames; finding a local maximum entropy level of the audio frames; and determining that the entropy levels of the set of audio frames are substantially constant if the difference between the local minimum entropy level and the local maximum entropy level is below a second threshold.

Embodiments of the invention may include, for a set of audio frames: finding the local minimum entropy level comprises selecting the minimal value between the entropy level of an incoming audio frame and the previous local minimum entropy level determined for an audio frame previous to the incoming audio frame; and finding the local maximum entropy level comprises selecting the maximum value between the entropy level of an incoming audio frame and the previous local maximum entropy level determined for an audio frame previous to the incoming audio frame.

According to some embodiments, one of the previous local minimum entropy level and the selected minimal value may be multiplied by a value larger than one, and one of the previous local maximum entropy level and the selected maximum value may be multiplied by a value smaller than one.

Embodiments of the invention may include performing single talk detection (STD) based on the entropy levels.

Embodiments of the invention may include: determining a global minimum of the entropy by finding a minimal value of the entropy levels in a predetermined time frame; determining that an audio frame contains speech originated from a single speaker if the difference between the level of entropy of the audio frame and the global minimum of the entropy is larger than a threshold; and determining that an audio frame contains speech originated from more than one speaker otherwise.

Embodiments of the invention may include performing noise cancellation by:

characterizing noise parameters based on audio frames that do not contain voice activity; and using the noise parameters for performing noise cancellation.

According to some embodiments performing VAD may include: detecting a sequence of audio frames in which the entropy levels are substantially constant across the sequence of frames and denoting an entropy level of the sequence as a background entropy; and identifying a current audio frame as containing voice activity if the difference between a level of entropy of the current audio frame and the background entropy is larger than a first threshold, and as not containing voice activity otherwise.

Embodiments of the invention may include performing noise cancellation by:

characterizing noise parameters based on audio frames that do not contain voice activity; and using the noise parameters for performing noise cancellation.

Embodiments of the invention may include performing single talk detection (STD) based on the entropy levels.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
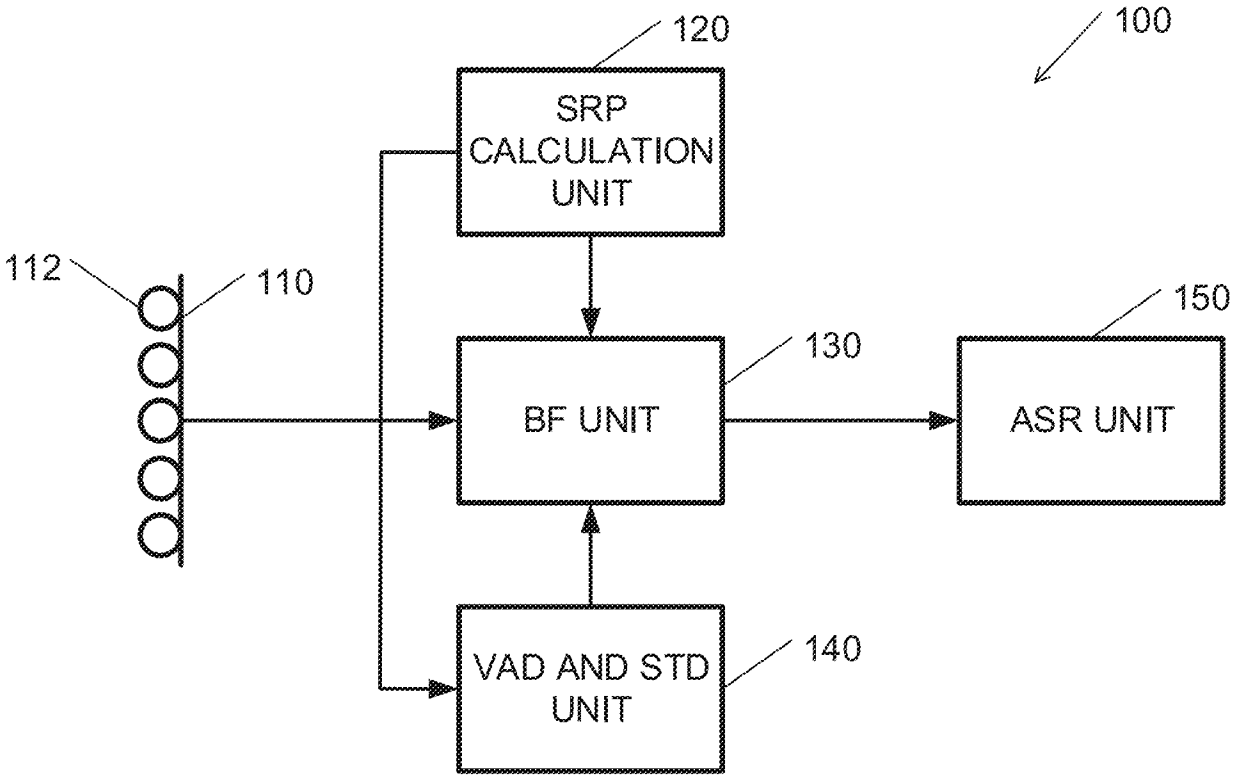
FIG. 1 schematically illustrates a system for performing speech recognition, according to embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details presented herein. Furthermore, well-known features may be omitted or simplified in order not to obscure the present invention.

Unless specifically stated otherwise, as apparent from the following discussions, it is appreciated that throughout the specification discussions utilizing terms such as "processing," "computing," "calculating." "determining," or the like, refer to the action and/or processes of a computer or computing system, or similar electronic computing device, that manipulates and/or transforms data represented as physical, such as electronic, quantities within the computing system's registers and/or memories into other data similarly represented as physical quantities within the computing system's memories, registers or other such information storage, transmission or display devices.

Embodiments of the invention pertain, inter alia, to the technology of speech recognition. Embodiments may provide an improvement to speech recognition technology by, for example, improving VAD and STD. VAD may enable to distinguish between a sequence of audio samples or frames that contain speech and audio frames that do not contain speech. Audio frames that do not contain speech include only noise. Thus, those frames may be analyzed in order to characterize, categorize or otherwise describe noise parameters. The noise parameters extracted from the audio frames that do not contain speech may then be used for performing noise cancellation from the audio frames that do contain speech, thus enhancing noisy speech (e.g. enhancing the speech component of a recording including speech and noise) and improving the voice quality. An audio frame may be a data structure including a plurality of audio samples, e.g., an audio frame may include 512 audio samples, or other number of audio samples. Audio frames may be sequential in time and contiguous so that two adjacent frames in a series represent a continual time segment from the original audio stream.

Embodiments of the invention may improve VAD performance, especially in cases of low SNRs using SRP values. An SRP value may provide an estimation of the probability (or pseudo probability) of the speaker to be in a certain direction. Embodiments of the invention may detect voiced (e.g., including human voice) audio segments based on changes in the directionality of the audio sources, which may provide a good distinction between noise and speech even in cases of low SNRs. As used herein the entropy may refer to a measure of disorder or uncertainty (similarly to information entropy), e.g., in the directionality of the background noise. Thus, according to embodiments of the invention, the entropy of SRP values may represent or provide a measure of the directionality of the background noise. In many scenarios, the entropy of SRP values of the background noise is typically piecewise constant over time, e.g., the entropy of the SRP values may remain constant or substantially constant or similar for time durations that are longer than a duration of a typical utterance of a speaker. Thus, in a time interval in which the entropy of the SRP values is constant or substantially constant (e.g., remains within a predetermined range, for example, ±10%), changes in the entropy of the SRP values may be attributed to the presence of speech. Embodiments of the invention may detect the typical behavior of the entropy of the SRP in noisy frames that do not contain speech, and may further detect changes in the entropy of the SRP values that probably occur due to the presence of speech. According to embodiments of the invention, the SRP behavior in noisy frames may be determined using the background value of the entropy of the SRP values. The entropy of the SRP values may be indicative of the directionality of the observed audio signals (e.g., the combination of noise and speech). A variation in the directionality with respect to the directionality of the noise, may imply on speech samples or frames. Embodiments of the invention may detect speech even in case of a moving noise source, since the directionality, as estimated using the entropy, may not change with the movement of the noise source, as opposed to the direction of the noise source which may change.

Background noise usually exhibits a relatively constant pattern at the output of SRP beamformer. Even when the noise is nonstationary, with fluctuating power, or dynamic direction, this pattern may be slowly time-varying. This typical pattern of the SRP value for noisy frames may be transformed to a single value by, for example, measuring the entropy of the SRP value. According to embodiments of the invention, significant differences between the instantaneous entropy and the entropy associated with the noise, may be attributed to presence of speech in the audio frames. Thus, the entropy of the SRP values may be used as a feature for VAD decisions. Embodiments of the invention may provide an adaptive technique for estimating the typical noise entropy for arbitrary noise fields.

According to embodiments of the invention, the entropy of the SRP values may be also beneficial for performing STD. Frames that are dominated by a single speaker may be important for separately estimating their characteristics, e.g., location and relative transfer function (RTF), that may be used for speaker separation tasks. In single-talk frames (e.g. including speech from one speaker only) the SRP values may be concentrated around the speaker DOA and thus may exhibit low entropy. When another speaker (or another directional or non-directional noise source) becomes active, the SRP values may be more spread relatively to the single-talk frames and thus may produce higher entropy. According to embodiments of the invention, single talk-frames may be identified by determining local minimum values of the entropy measure.

Reference is made to FIG. 1, which schematically illustrates a system 100 for performing speech recognition, according to embodiments of the invention. System 100 may include a microphone set or array 110, VAD and STD unit 140, SRP calculation unit 120, beamforming (BF) unit 130, and automatic speech recognition (ASR) unit 150.

Microphone set or array 110 may include a plurality of microphones 112 arranged in any desired spatial configuration. The plurality of microphones may be arranged in a linear array, e.g., with I microphones along an x axis, a planar array, e.g., with I microphones along an x axis by J microphones along y axis, or may be distributed about a perimeter of a shape, e.g., a perimeter of a circle (circular arrays). Microphone array 110 may provide multiple spatial samples of audio waves. Using a microphone array 100 instead of a single microphone may improve the quality of the captured sound by taking advantage of the plurality of samples and using advanced techniques for noise cancellation.

According to embodiments of the invention, VAD may be determined using the multichannel signals sampled by microphone array 110. The samples may include speech in a noisy environment, and may be modelled in the short-time Fourier transform (STFT) domain as for example:

$$Y_i(m,k) = \begin{cases} X_i(m,k) + V_i(m,k) & \mathcal{H}_1 \\ V_i(m,k) & \mathcal{H}_0 \end{cases}, \quad \text{(Equation 1)}$$

Where $Y_i(m,k)$ denotes a sample of the $i^{th}$ microphone at time or frame number m and frequency k, $X_i(m,k)$ denotes the speech component in sample $Y_i(m,k)$, and $V_i(m,k)$ denotes the ambient noise in sample $Y_i(m,k)$. $\mathcal{H}_1$ and $\mathcal{H}_0$ denote the speech presence and absence hypotheses, respectively. According to embodiments of the invention. VAD may include determining the most likely hypothesis, e.g., $\mathcal{H}_1$ or $\mathcal{H}_0$, in each time or frame number m.

SRP calculation unit 120 may calculate SRP values (e.g., raw SRP values), e.g. for the audio samples or frames, or for each frame, and may provide, based on these values, the probability of a speaker (a person speaking) being located in any one of N directions (e.g., normalized SRP values). For example, the raw SRP values may be normalized (e.g., by dividing each SRP value by the summation of all the raw SRP values) to be summed to 1. Then, each normalized SRP value may be considered as a probability of the speaker to be in a direction associated with the SRP value. SRP calculation unit 120 may provide an N-length vector of probabilities (e.g. an ordered set of values). SRP calculation unit 120 may provide a direction of arrival (DOA) of the audio, e.g., based on the vector of probabilities. For example, in case of speech, SRP calculation unit 120 may provide a DOA of the voice and thus may point to the direction of the speaker.

According to some embodiments of the invention, SRP may be calculated by the SRP-phase transform (PHAT) algorithm, which is an adaptation of the generalized cross correlation phase transform (GCC-PHAT) to an array of microphones in far-field scenarios. However, other algorithms may be used for calculating SRP.

According to some embodiments the SRP-PHAT algorithm may include calculating time smoothed cross-correlation between each two microphones for all i=1, . . . , N and j=i+1, . . . , N:

$$R_{i,j}(m,k)=\alpha R_{i,j}(m-1,k)+(1-\alpha)Y_i(m,k)Y_j^*(m,k), \quad \text{(Equation 2)}$$

Where $R_{i,j}$ (m,k) is the time smoothed cross-correlation between the $i^{th}$ and $j^{th}$ microphones at time index m and frequency k, * denotes a complex conjugate, and α is a smoothing or forgetting factor which may be determined empirically. in some embodiments α may be in the range of 0.9 to 1.4, other values may be used.

Next, a predefined set of DOAs may be examined. The DOA may be expressed as an angle θ relatively to a known baseline direction. For example, in circular arrays a full panoramic space may be examined, e.g., DOAs of θ=0°, . . . , 360° and DOAs of θ=0, . . . , 180° for a linear microphone array. The interval of θ may be referred to as the resolution of the DOA measurement and may be determined based on the number of microphones in microphone array 100, e.g., the resolution may increase as the number of microphones increase. The resolution or the intervals of θ may be determined according to the computational power of the processor performing the calculations (e.g., processor 905 depicted in FIG. 9), user requirements, number of microphones and other factors. For example, intervals of 10°, 15°, 20° may be used. Other intervals may be used. DOAs may be estimated by calculating the raw SRP or normalized SRP from each direction. For example, the angle θ with the maximum value (or a value above a threshold) of the raw SRP or normalized SRP may be considered as the DOA.

When a directional signal originated from DOA θ is perceived by two microphones there may be an expected phase difference between the two observations in the frequency domain, since time-delay in the time domain is transformed to a phase difference in the frequency domain. The expected phase difference, $G_{i,j}$, may refer to the phase difference between the signals that would be perceived at the $i^{th}$ and $j^{th}$ microphones if a speaker would be active from DOA θ. These expected phase differences may be pre-calculated for each microphone pair and each DOA θ. For example, the expected phase difference, $G_{i,j}$, between the $i^{th}$ and $j^{th}$ microphones when the speaker is active from DOA θ may be calculated by:

$$G_{i,j}(k,\theta)=\exp\left(-\tau\frac{2\pi k}{K}\frac{T_{i,j}(\theta)}{T_s}\right), \quad \text{(Equation 3)}$$

Where K is the total number of examined frequencies, $T_s$ is the sampling time, r indicates imaginary number, and $T_{i,j}(\theta)$ is the expected time difference of arrival (TDOA) between the $i^{th}$ and $j^{th}$ microphones when the speaker is active from DOA θ. The expected TDOA, $T_{i,j}$, may refer to the difference in arrival time of the signal at two microphones, e.g., the $i^{th}$ and $j^{th}$ microphones. The expected TDOA, $T_{i,j}$, may also be pre-calculated for each microphone pair and each DOA θ. For example, for a uniform linear array (ULA), the TDOA, $T_{i,j}$, may equal:

$$T_{i,j}(\theta)=(i-j)\frac{d\cos(\theta)}{c}, \quad \text{(Equation 4)}$$

where d is a physical distance between the $i^{th}$ and $j^{th}$ microphones and c is the sound velocity. It should be noted that $G_{i,j}(k,\theta)$ may be calculated in advance. The raw SRP values may be calculated by for example:

$$Q(m,\theta)=\Re\left\{\sum_k\sum_{i=1}^{N}\sum_{j=i+1}^{N}\frac{R_{i,j}(m,k)}{|R_{i,j}(m,k)|}G_{i,j}^*(k,\theta)\right\}, \quad \text{(Equation 5)}$$

Where $\overline{Q}(m,\theta)$ denotes raw SRP value at time index m and angle θ, and $\Re\{\cdot\}$ is a function extracting a real-value component of an operand. The raw SRP values may be normalized (e.g., by dividing each SRP value by the summation of all the SRP values) to a probability density function, for example:

$$\overline{Q}(m,\theta)=\frac{Q(m,\theta)}{\sum_\theta Q(m,\theta)}, \quad \text{(Equation 6)}$$

Where $\overline{Q}(m,\theta)$, also referred to herein as normalized SRP values or SRP values, denotes the probability of the speaker to be in a direction θ and time index m.

In a presence of speaker and directional noise SRP calculation unit 120 may detect high energy sources in both directions e.g., the direction of the speaker and the direction of the noise. The distinction between the speaker and the noise may be impossible to make. However, if the noise is non-directional the SRP calculation unit 120 may easily detect the direction of the speaker even in low SNR cases.

According to embodiments of the invention, the directionality of the sampled signal, reflected in the output of SRP calculation unit 120, may be almost constant for continuously active noise sources, and the directionality may significantly change only when speech is added. When the noise type is non-directional, the SRP values may be assumed to be approximately equal for all DOAs. For example, in circular microphone arrays $\overline{Q}(m,\theta)$ may equal $$\frac{1}{M}$$

for any θ, where M denotes the number of examined angles (e.g., the number of θ values). When the noise type is directional, $\overline{Q}(m,\theta)$ may exhibit one significant maximum point. When a speaker is also active in addition to the nondirectional or directional noise, the directionality may change since another maximum point may be added.

VAD and STD unit 140 may identify the presence or absence of voice activity (e.g. speech) represented in audio samples or frames, and may determine if an audio sample includes or does not include speech. According to embodiments of the invention. VAD and STD unit 140 may obtain the probability density function. $\overline{Q}(m,\theta)$, may calculate an entropy value or level and may determine presence or absence of speech based on the entropy, as disclosed herein.

As used herein, entropy may provide a measure of uncertainty in the DOA. For example, in case of directional noise, the level of uncertainty in the DOA may be considered low and the entropy may typically be low, while in case of non-directional noise, the level of uncertainty in the DOA may be considered high and the entropy may typically be high. For example, entropy may obtain its maximum value when $\overline{Q}(m, \theta)$ is "flat" or constant for all angles θ, and may obtain its minimum value if there is a dominant direction in $\overline{Q}(m, \theta)$. Thus, the entropy may measure the directionality of the sampled signal. In the presence of a directional background noise, the background entropy (e.g., the entropy attributed to the noise) may be relatively low and may increase when the speaker is also active; in the presence of nondirectional background noise, the background entropy may be relatively high and may decrease when the speaker is also active.

Beamforming is a well-known noise reduction technique, that may exploit the spatial diversity of microphone arrays. Waves of the same frequency may be combined, either constructively or destructively, in order to enhance or cancel a wave coming from a certain direction. For example, waves of the same frequency recorded by microphones 112 may be multiplied by appropriate weights so that the noise is reduced, and the desired speech is enhanced. For example, a delay and sum (D&S) beamformer may steer the array to the speaker direction while arbitrarily summing the noise components. A minimum variance distortionless response (MVDR) beamformer may whiten the noise and then employ a D&S beamformer. The MVDR beamformer requires two major information sets: the speaker position (e.g., the DOA) and the noise characteristics. To automatically learn the noise characteristics, audio frames that do not contain speech, and therefore contain only noise, should be identified. Thus, it is desirable that a reliable VAD is designed. BF unit 130 may obtain or receive an audio signal such as audio samples or frames from microphone array 100, an indication whether an audio frame contain or does not contain speech from VAD and STD unit 140, and a DOA of the audio from SRP calculation unit 120. BF unit 130 may reduce the ambient noise in the audio frames based on the speech indication and the DOA. Audio data may be received in a format other than audio frames, but in a typical embodiment audio frames are used as input when determining VAD. For example, BF unit 130 may calculate noise parameters such as the noise spatial characteristics, e.g., the power spectral density (PSD) matrix of the noise, based on audio frames that do not contain voice activity, and may use the noise spatial characteristics for performing noise cancellation. For example, BF unit 130 may calculate weights that may be used to filter and sum the microphone signals, based on the noise PSD matrix and the steering vector (a vector that may represent the expected phase difference between each microphone signal and a reference microphone located in the assumed DOA of the speaker). BF unit 130 may calculate weights that may preserve the signal impinged from the assumed DOA of the speaker undistorted, while reducing as much as possible the ambient noise. For example, BF unit 130 may use the calculated weights to perform pre-whitening of the noise and then activate a D&S beamformer.

ASR unit 150 may obtain the processed audio frames from BF unit 130, e.g., the audio frames after noise cancellation, and may perform speech recognition. For example, ASR unit 150 may convert spoken words included in the voiced audio frames to text, and may perform other tasks that are required to understand the meaning of the words and the intention of the speaker.

Figure 2B:
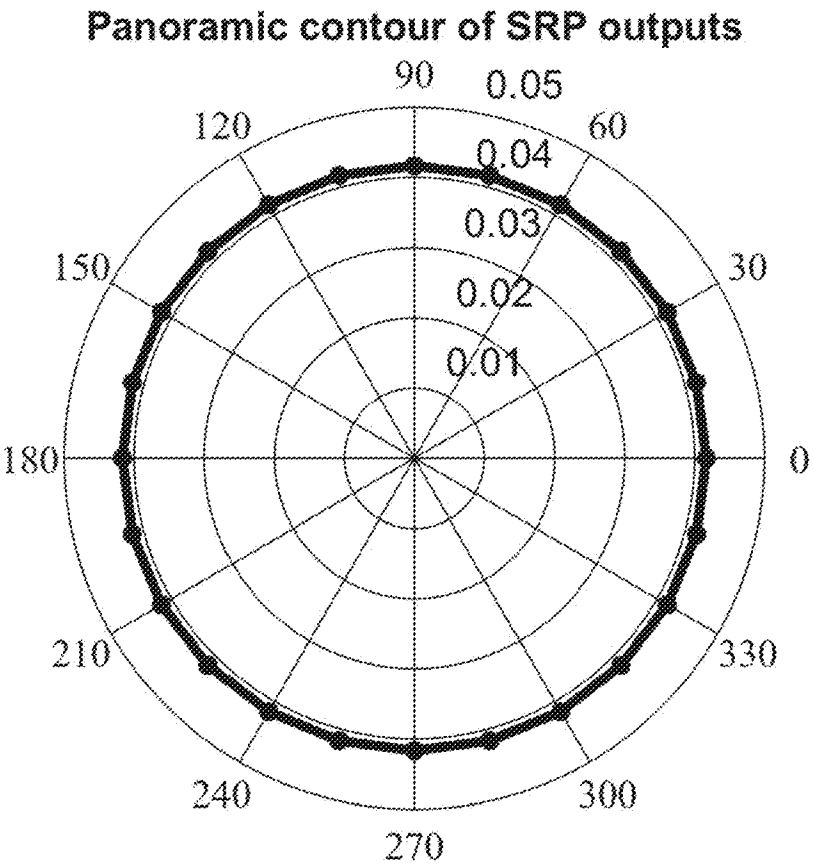
FIG. 2B provides an example of a panoramic contour of SRP values, for non-directional noise, helpful in demonstrating embodiments of the invention.
Figure 2A:
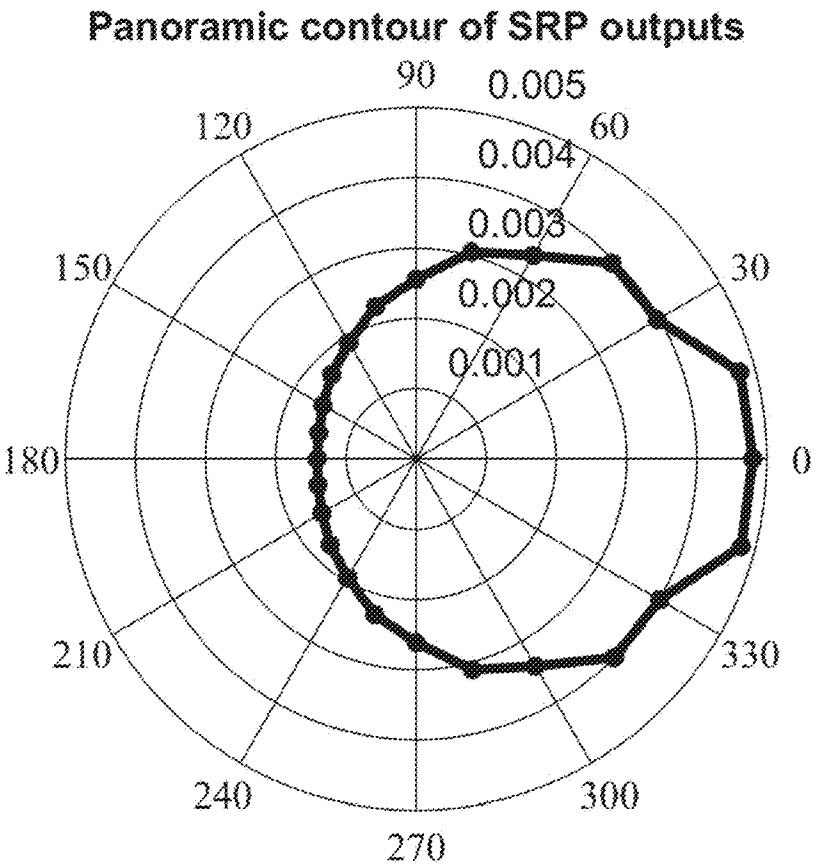
FIG. 2A provides an example of a panoramic contour of SRP values for directional noise, helpful in demonstrating embodiments of the invention.

According to one interpretation, entropy may be seen as or may be a measure of the amount of uncertainty of $\overline{Q}(m, \theta)$. The entropy value or level would be high if $\overline{Q}(m, \theta)$ includes uniform distribution, and low if $\overline{Q}(m, \theta)$ exhibits centered distribution. The two theoretical extreme cases of entropy levels are uniform distribution of $\overline{Q}(m, \theta)$, $$\overline{Q}(m, \theta) = \left[\frac{1}{M}, \frac{1}{M} \ldots \frac{1}{M}\right],$$

and a substantially perfectly directional distribution, $\overline{Q}(m,\theta)=[1-(M-1)\epsilon, \epsilon, \ldots \epsilon]$, where ϵ is an arbitrarily small positive number. FIG. 2A provides an example of a panoramic contour of SRP values, for directional noise, and FIG. 2B provides an example of a panoramic contour of SRP values, for non-directional noise. The entropy value or level of these two extreme cases may be given by for example:

$$\text{If } \overline{Q}(m, \theta) = \left[\frac{1}{N}, \frac{1}{N} \ldots \frac{1}{N}\right] \Rightarrow En(m) = \log_2 N \quad \text{(Equation 7)}$$

$$\text{If } \overline{Q}(m, \theta) = [1-(N-1), \epsilon, \epsilon \ldots \epsilon] \Rightarrow En(m) \underset{\epsilon \to 0}{\longrightarrow} 0 \quad \text{(Equation 8)}$$

The values in equations 7 and 8 may provide boundaries for possible entropy levels. In case of directional noise, the entropy may typically be low, as in equation 8, while in case of non-directional noise the entropy may typically be high, as in equation 7. According to equation 7 the possible maximum value of the entropy is $\log_2$ N. While the possible minimum value according to equation 8 equals zero, this implies to a theoretical case of an infinite number of microphones 112 in microphone array 110. In more realistic cases the possible minimum value is higher than zero and depends on the constellation of microphone array 110. For pure directional source located in front of the array and a uniform linear microphone array 110 the observed beam pattern may be provided by:

$$\overline{Q}(m, \theta) \propto \frac{1}{M} \frac{\sin\left(\pi M \frac{d}{\lambda}(\cos(\theta))\right)}{\sin\left(\pi \frac{d}{\lambda}(\cos(\theta))\right)} \quad \text{(Equation 9)}$$

Where M is the number of microphones, d is the distance between two close microphones, λ is the speech wavelength (usually 30 cm) and θ are the examined degrees with relation to the longitudinal axis of the linear array. According to equation 9, the entropy $r_t$ decreases as M increases. The term in equation 9 may approach the Dirac delta as M approaches infinity. Specifically, the SRP value from the DOA of the speaker may approach infinity while the other values are zero.

Figure 3:
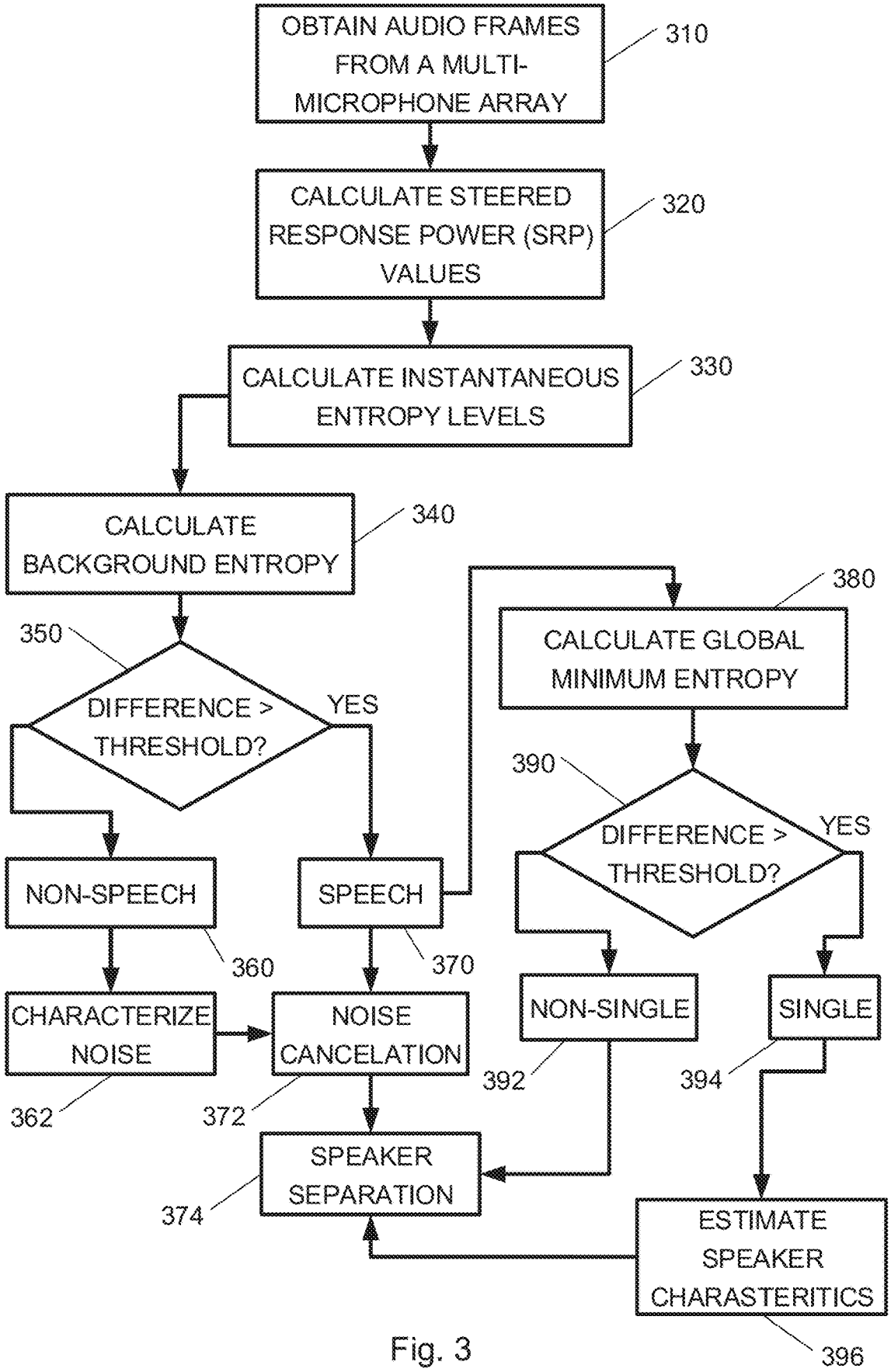
FIG. 3 is a flowchart of a method for performing VAD and single talk detection (STD), according to embodiments of the invention.

Reference is now made to FIG. 3 which is a flowchart of a method for performing VAD and STD, according to embodiments of the present invention. The method for performing VAD and STD may be performed, for example, by SRP calculation unit 120 and VAD and STD unit 140 presented in FIG. 1. In operation 310 audio recordings may be obtained from a multi-microphone array. Audio may be sampled by a microphone array such as microphone array 110, for example at sampling rate of 16 kHz (or a different sample rate), and samples may be organized into audio frames. In operation 320 SRP values of the audio frames may be calculated, e.g., by SRP calculation unit 120. An N-length vector of probabilities, $\overline{Q}(m, \theta)$, including the probability of a speaker in any one of N directions may also be provided. In operation 330, instantaneous entropy levels, denoted as En(m), may be calculated, based on the vector of probabilities, e.g., using:

$$En(m) = -\Sigma_\theta \overline{Q}(m,\theta) \log_2 \overline{Q}(m,\theta) \quad \text{(Equation 10)}$$

An entropy level of a current or incoming audio frame may be referred herein as the instantaneous entropy level.

In operation 340 background entropy, $\overline{E}_n$, may be estimated or calculated. For example, a sequence (e.g. a series of frames ordered by time of recording, the frames being contiguous in time) of audio frames in which the entropy levels are substantially constant, or vary within a narrow predefined range, during or across the sequence of frames may be detected. An entropy level of the sequence may be designated or denoted as a background entropy. $\overline{E}_n$. For example, the background entropy may equal an average of the entropy level across or during the sequence. Other methods for deriving the background entropy, or the entropy of the sequence, may be used.

In some embodiments a local minimum, $E_n^{Lmin}(m)$, and a local maximum. $E_n^{Lmax}(m)$, of the instantaneous entropy $E_n(m)$ may be tracked. In some embodiments, the local minimum may be estimated by selecting a minimum value between the instantaneous entropy. $E_n(m)$, and the last value of the local minimum, $E_n^{Lmin}(m-1)$. The last value of the local minimum, $E_n^{Lmin}(m-1)$ or the selected minimum value may be multiplied by a value slightly larger than one, e.g., by $(1+\varepsilon)$, where $\varepsilon$ is a small constant (e.g., $\cong 10^{-4}$) that may prevent $E_n^{Lmin}(m)$ from being trapped at a global minimum point. The local maximum may be estimated by selecting a maximum value between the instantaneous entropy, $E_n(m)$, and the last value of the local maximum, $E_n^{Lmax}(m-1)$. The last value of the local maximum, $E_n^{Lmax}(m-1)$ or the selected minimum value may be multiplied by a value slightly smaller than one, e.g., by $(1-\varepsilon)$, that may prevent $E_n^{Lmax}(m)$ from being trapped at a global maximum point. For example, the local minimum and maximum may be estimated by for example:

$$E_n^{Lmin}(m)=\min\{E_n^{Lmin}(m-1),E_n(m)\}\cdot(1+\varepsilon) \quad \text{(Equation 11)}$$

$$E_n^{Lmax}(m)=\max\{E_n^{Lmax}(m-1),E_n(m)\}\cdot(1+\varepsilon) \quad \text{(Equation 12)}$$

Other equations may be used, for example:

$$E_n^{Lmin}(m)=\min\{E_n^{Lmin}(m-1)\cdot(1+\varepsilon),E_n(m)\} \quad \text{(Equation 13)}$$

$$E_n^{Lmax}(m)=\max\{E_n^{Lmax}(m-1)\cdot(1+\varepsilon),E_n(m)\} \quad \text{(Equation 14)}$$

In equation 11 the smaller value among the instantaneous entropy, $E_n(m)$, or the former or previous local minimum, $E_n^{Lmin}(m-1)$, (e.g., the last value of the local minimum as was determined for an audio frame immediately previous to the incoming audio frame) may be selected and multiplied by $(1+\varepsilon)$, and in equation 12 the larger value among the instantaneous entropy, $E_n(m)$, or the former or previous local maximum, $E_n^{Lmax}(m-1)$, (e.g., the last value of the local maximum as was determined for an audio frame immediately previous to the incoming audio frame) may be selected and multiplied by $(1-\varepsilon)$. The local range of the entropy may be estimated by the distance between the local maximum and minimum. e.g.:

$$E_n^{Range}(m)\equiv|E_n^{Lmax}(m)-E_n^{Lmin}(m)|, \quad \text{(Equation 15)}$$

The background entropy, $\overline{E}_n$, may be updated only in frames in which the local minimum, $E_n^{Lmin}(m)$, and maximum $E_n^{Lmax}(m)$, are close enough, e.g.:

$$\overline{E}_n=\begin{cases}\overline{E}_n & E_n^{Range}(m)\geq\zeta\\ \beta\overline{E}_n+(1-\beta)E_n(m) & E_n^{Range}(m)<\zeta\end{cases}, \quad \text{(Equation 16)}$$

Where $\beta$ is a decay factor. For example, $\beta$ may equal 0.9, or other value. The threshold $\zeta$ may equal 0.05, 0.1, or another value. Thus, if the absolute value of the difference between the the local minimum, $E_n^{Lmin}(m)$, and the local maximum, $E_n^{Lmax}(m)$, is larger or higher than the threshold, $\zeta$, then it may be decided that the entropy is not substantially constant, and the background entropy, $E_n$, should not be updated. If, however, the absolute value of the difference between the the local minimum, $E_n^{Lmin}(m)$, and the local maximum, $E_n^{Lmax}(m)$, is lower than the threshold. $\zeta$, then it may be decided that the entropy is substantially constant and the background entropy, $\overline{E}_n$, may be updated. Other equations may be used, for example:

$$\overline{E}_n=\beta*\overline{E}_n+(1-\beta)*\begin{cases}\overline{E}_n & E_n^{Range}(m)\geq\zeta\\ \dfrac{E_n^{Lmax}(m)+E_n^{Lmin}(m)}{2} & E_n^{Range}(m)<\zeta\end{cases}, \quad \text{(Equation 17)}$$

Other methods may be used to determine if the entropy is substantially constant and to update the background entropy. For example, it may be determined that if the entropy does not change by more than a predetermined value, e.g., 0.1, during a pre-determined time window, e.g., 1-2 seconds, than the entropy is substantially constant, and that the background entropy equals the average entropy in the time window. A value may be substantially constant if it varies within a predefined range across or during a certain time period.

In operation 350 an incoming audio frame may be identified as containing or not containing voice activity based on entropy, e.g. according to the difference between a level of entropy of the current or incoming audio frame (the instantaneous entropy) and the background entropy. The following example decision rule may be used:

$$VAD_{SRP}(m)=\begin{cases}1 & |E_n(m)-\overline{E}_n|\geq\eta_{VAD}\\ 0 & |E_n(m)-\overline{E}_n|<\eta_{VAD}\end{cases} \quad \text{(Equation 18)}$$

Where $VAD_{SRP}(m)$ is the SRP based VAD for time index m, and $\eta_{VAD}$ is a threshold. For example, the threshold $\eta_{VAD}$ may equal 0.05, 0.1, or other value. Thus, if $VAD_{SRP}(m)=1$, then an audio frame related to time index m may contain speech, and if $VAD_{SRP}(m)=0$, then the audio frame related to time index m may not contain speech. Thus, if the difference between the level of entropy of the current audio frame and the background entropy is larger or higher than a threshold, $\eta_{VAD}$, it may be determined that the current audio frame contains speech, as indicated in block 370, and if the difference between the level of entropy of the current audio frame and the background entropy is not larger than the threshold it may be determined that the current audio frame does not contain voice activity or speech, as indicated in block 360.

In some embodiments $VAD_{SRP}(m)$ may be further refined, for example using other VAD methods. For example, a final VAD(m) decision may be made by using an OR operation between an energy-based VAD(m) and the SRP-based VAD, $VAD_{SRP}(m)$:

$$VAD(m)=VAD(m)\ \text{OR}\ VAD_{SRP}(m) \quad \text{(Equation 19)}$$

According to the decision rule of equation 19, it may be determined that an audio frame related to time index (m)

contains speech if one of the energy based VAD(m) and the SRP based VAD(m) indicates that the audio frame contains speech. In case both the energy-based VAD(m) and the SRP-based VAD(m) indicate that the audio frame does not contain speech, it may be determined that the audio frame does not contain speech. It is noted that the energy-based VAD tends to imply 'noise' even when speech is present in low SNR cases. However, the directionality of the observed signals changes when speech is presented even in low SNR cases. Thus, employing the SRP values to detect these changes in directionality according to embodiments of the invention may improve the VAD performance. Other VAD methods and operations may be used in conjunction with the SRP-based VAD disclosed herein.

In operation 380 a global minimum of the entropy, $E_n^{Gmin}$, may be estimated or calculated. For example, the global minimum of the entropy, $E_n^{Gmin}$, may be the minimal value of the instantaneous entropy in a predetermined time frame or time window such as one hour, one day or one week, etc. In some embodiments, the global minimum of the entropy, $E_n^{Gmin}$, may be estimated or calculated based on voiced audio frames in the time frame or time window. In some embodiments, the global minimum of the entropy, $E_n^{Gmin}$, may be estimated or calculated based on all the audio frames in the time frame or time window. In operation 390 entropy-based STD may be determined, e.g., it may be determined if only one speaker is active in voiced audio frames, e.g. if the frames contain voice activity of one speaker. For example, STD may be performed based on the difference between a level of entropy of the current or incoming audio frame (the instantaneous entropy) and the global minimum of the entropy, $E_n^{Gmin}$. The following example decision rule may be used:

$$STD(m) = \begin{cases} 1 & |E_n(m) - E_n^{Gmin}| \geq \eta_{STD} \\ 0 & |E_n(m) - E_n^{Gmin}| < \eta_{STD} \end{cases} \quad \text{(Equation 20)}$$

Where STD(m) is the entropy-based STD value for time index m, and $\eta_{STD}$ is a threshold. For example, the threshold $\eta_{STD}$ may equal 0.05, 0.1, or other value. For example, if STD(m)=1, then it may be determined that only one speaker is active in the audio frame related to time index m, and if STD(m)=0, then it may be determined that more than one speaker is active in the audio frame related to time index m. Thus, if the difference between the level of entropy of the current audio frame and the global minimum of the entropy is larger or higher than a threshold, $\eta_{STD}$, it may be determined that the current audio frame contains speech originated from a single speaker, as indicated in block 394, and if the difference between the level of entropy of the current audio frame and the global minimum of the entropy is not larger than (e.g., equal to or smaller than) the threshold, $\eta_{STD}$, it may be determined that the current audio frame contains speech originated by two or more speakers, as indicated in block 392.

In operation 362, noise parameters may be characterized based on audio frames that do not contain voice activity, e.g., audio frames that were recognized as not containing speech in operation 360. Frames that do not contain speech may be analyzed in order to characterize, categorize or otherwise describe noise parameters. For example, the noise parameters may include the noise spatial characteristics, e.g., the PSD matrix of the noise. In operation 372 the noise parameters extracted from the audio frames that do not contain speech (e.g., in operation 362) may be used for performing noise cancellation from the audio frames that do contain speech (e.g., audio frames that were recognized as containing speech in operation 370). Noise cancellation may enhance noisy speech (e.g. enhancing the speech component of a recording including speech and noise) and improve the voice quality. For example, the noise spatial characteristics may be used for performing noise cancellation. In some embodiments, weights may be calculated and used to filter and sum the microphone signals, based on the noise PSD matrix and the steering vector. For example, the weights may be calculated to preserve the signal impinged from the assumed DOA of the speaker undistorted, while reducing as much as possible the ambient noise. The calculated weights may be used to perform pre-whitening of the noise and then activate a D&S beamformer. In operation 396, speaker characteristics may be estimated based on audio frames that include a single speaker. For example, the speaker characteristics may include location and an RTF. In operation 374, the speaker characteristics may be used for speaker separation tasks, for example using beamforming and other methods. In some embodiments, blocks 380, 390, 392 and 394 may be performed only for audio frames that contain speech.

Figure 4A:
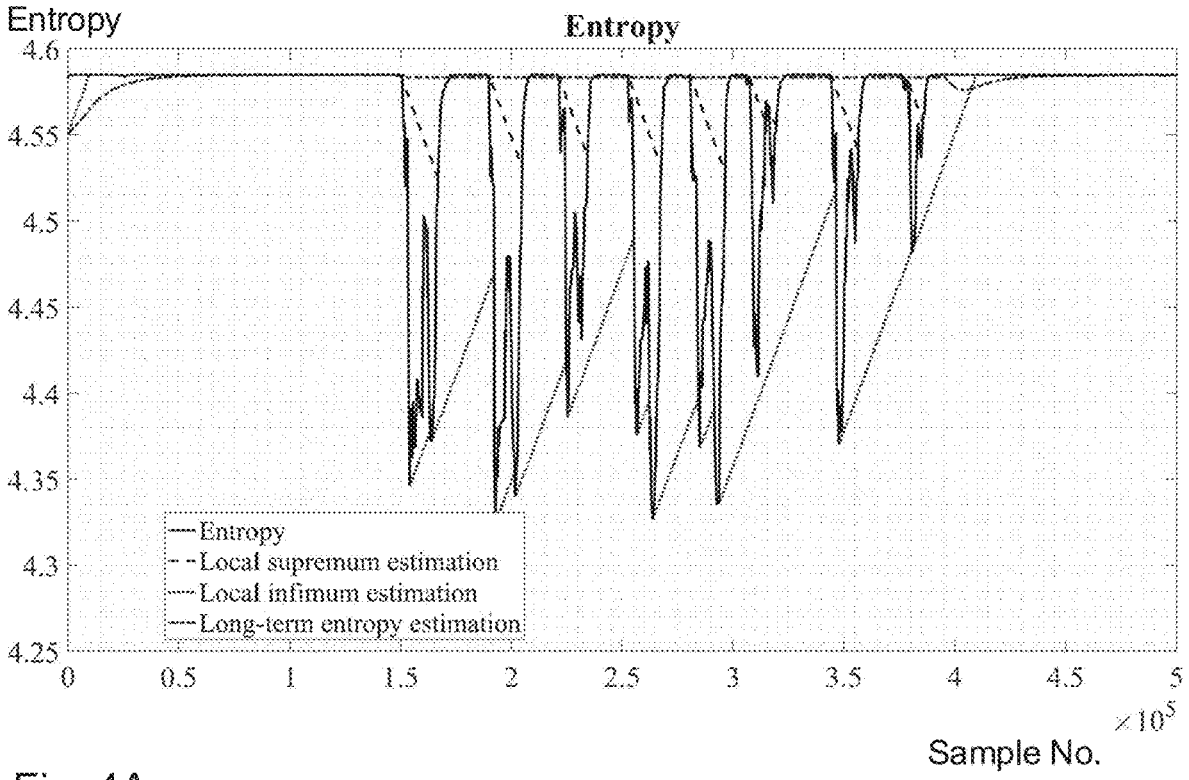
FIG. 4A depicts the instantaneous entropy, local minimum, local maximum, and background entropy, calculated according to embodiments of the invention, of an audio signal recorded by a microphone array in case of speech and non-directional noise.
Figure 4B:
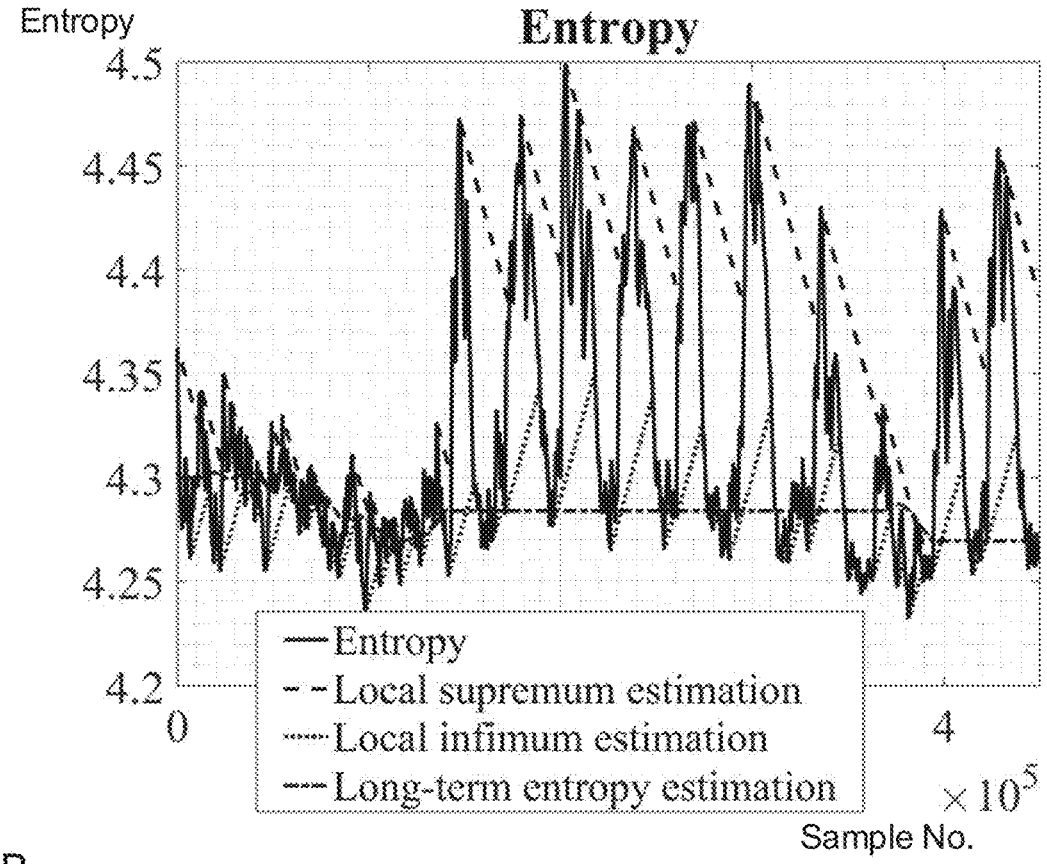
FIG. 4B depicts the instantaneous entropy, local minimum, local maximum and background entropy, calculated according to embodiments of the invention, of an audio signal recorded by a microphone array in case of speech and directional noise.

FIG. 4A depicts the instantaneous entropy, local minimum, local maximum and background entropy verses sample number of an audio signal recorded by a microphone array in case of speech and non-directional noise, calculated according to embodiments of the invention. FIG. 4B depicts the instantaneous entropy, local minimum, local maximum and background entropy of an audio signal recorded by a microphone array in case of speech and directional noise, calculated according to embodiments of the invention. Equations 13, 14 and 17 were used to calculate the local minimum, $E_n^{Lmin}$(m), local maximum, $E_n^{Lmax}$(m) and background entropy. $\overline{E}_n$, respectively. The sampling rate in FIGS. 4A and 4B is 16 kHz. In the scenario presented in FIGS. 4A and 4B, eight microphones are used and the number of examined angles may equal M=24 were used in a circular microphone array, the maximal possible value for the entropy is 4.58 and the minimal possible value (the number of microphones equals eight) is 4.2. Other values may be used. As can be seen in FIG. 4A, the background entropy is relatively high and equals or substantially equals the instantaneous entropy, the local minimum and the local maximum in regions that do not contain speech 410. In the presence of speech, which is a directional audio wave, the instantaneous entropy decreases, and the values of the local minimum and the local maximum are far apart. In FIG. 4B, the background entropy is relatively low and close in value to the instantaneous entropy, the local minimum and the local maximum in regions that do not contain speech 430. In the presence of speech, which is a second directional audio wave, the instantaneous entropy increases, and the values of the local minimum and the local maximum are far apart.

Figure 5A:
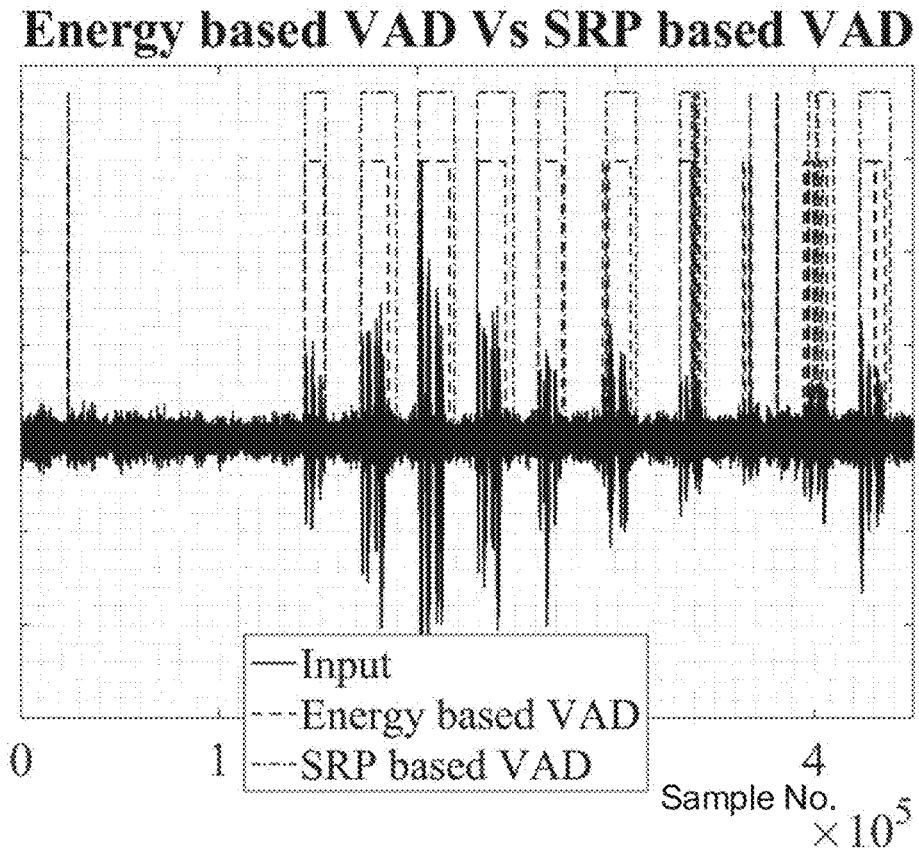
FIG. 5A depicts energy-based VAD and SRP-based VAD, calculated according to embodiments of the invention, in case of directional noise.
Figure 5B:
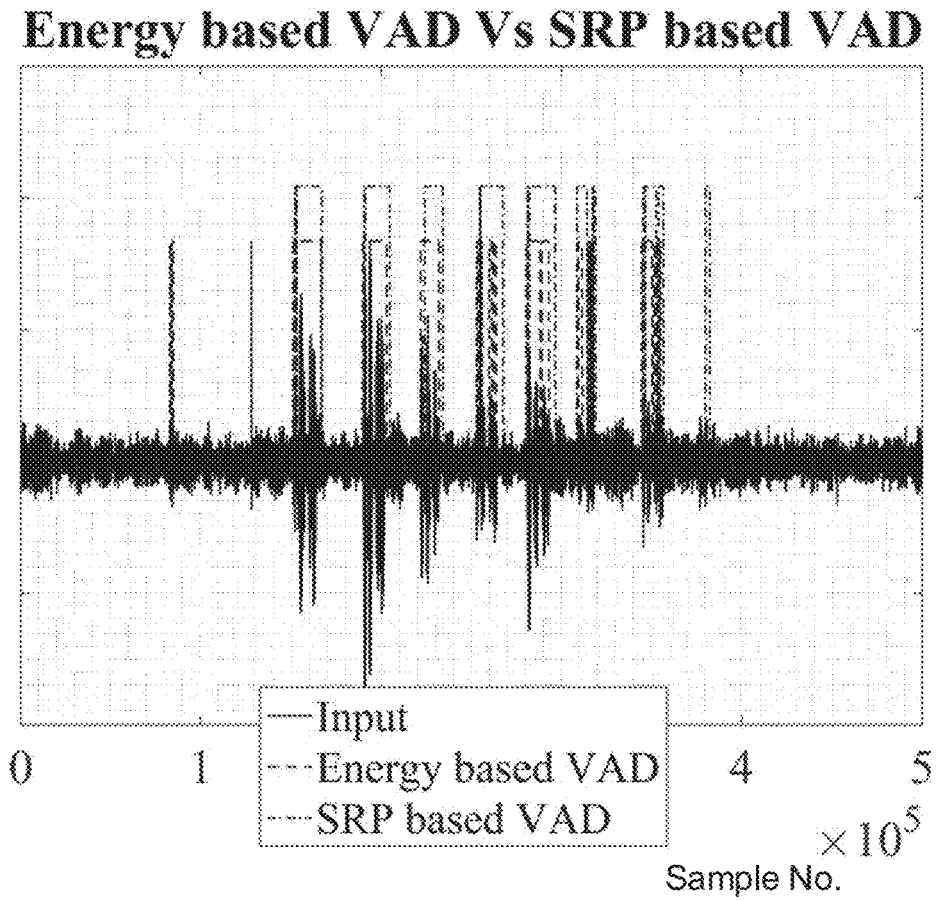
FIG. 5B depicts energy-based VAD and SRP-based VAD, calculated according to embodiments of the invention, in case of non-directional noise.

FIG. 5A depicts experimental results with the same experimental setup as in FIGS. 4A and 4B, showing energy-based VAD and SRP-based VAD, calculated according to embodiments of the invention, in case of directional noise. FIG. 5B depicts experimental results showing energy-based VAD and SRP-based VAD, calculated according to embodiments of the invention, in case of non-directional noise. In the example depicted in FIGS. 5A and 5B VAD values may equal 0 (zero) for non-voiced samples or 1 (one) for voiced samples, and are shown on top of the input signal. Other binary representations may be used.

FIGS. 6A-C, 7A-C and 8A-B depict experimental results with the following setup, according to some embodiments.

Experiments were made by recording speech and noise or only speech using a microphone array. The microphone array used for the recordings included 13 digital microphones in a circular array. Equations 11, 12 and 16 were used to calculate the local minimum, $E_n^{Lmin}(m)$, local maximum, $E_n^{Lmax}(m)$ and background entropy. $\overline{E}_n$, respectively. The signals were captured using pulse-width modulation (PDM) in 1.5 MHz, and then transformed into pulse-code modulation (PCM) in 16 kHz using a cascaded integrator comb (CIC) filter. Thus, the sampling interval, $T_s$, is 1/16 kHz. As a comparison, energy-based VAD was calculated, using one of the microphone signals. Parameter values used in the experiments are listed in Table 1.

TABLE 1

| Experiment parameters | | | | | | | | | | |
|---|---|---|---|---|---|---|---|---|---|---|
| $T_s$ | K | k | θ | N | α | $\eta_{VAD}$ | ε | β | ζ | $\eta_{STD}$ |
| 1/16 kHz | 512 | 10 to 90 | 0 | 7 | 0.9 | 0.1 | $10^{-4}$ | 0.99 | 0.05 | 0.1 |

Figure 6A:
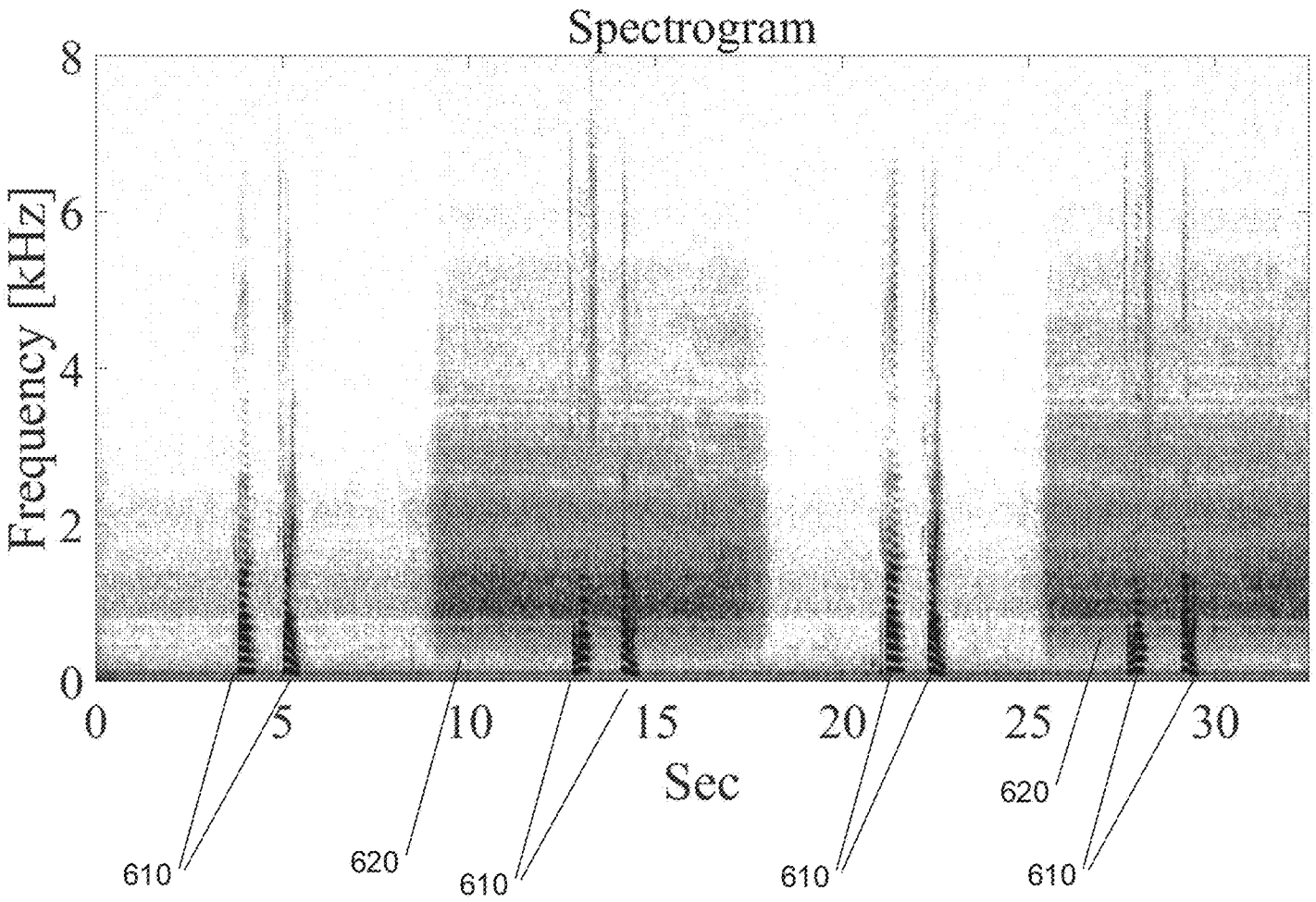
FIG. 6A depicts a sonogram of an audio signal recorded by a microphone array in an experimental setup including a speaker and a directional noise source with fluctuating amplitude, which may be used with embodiments of the invention.
Figure 6B:
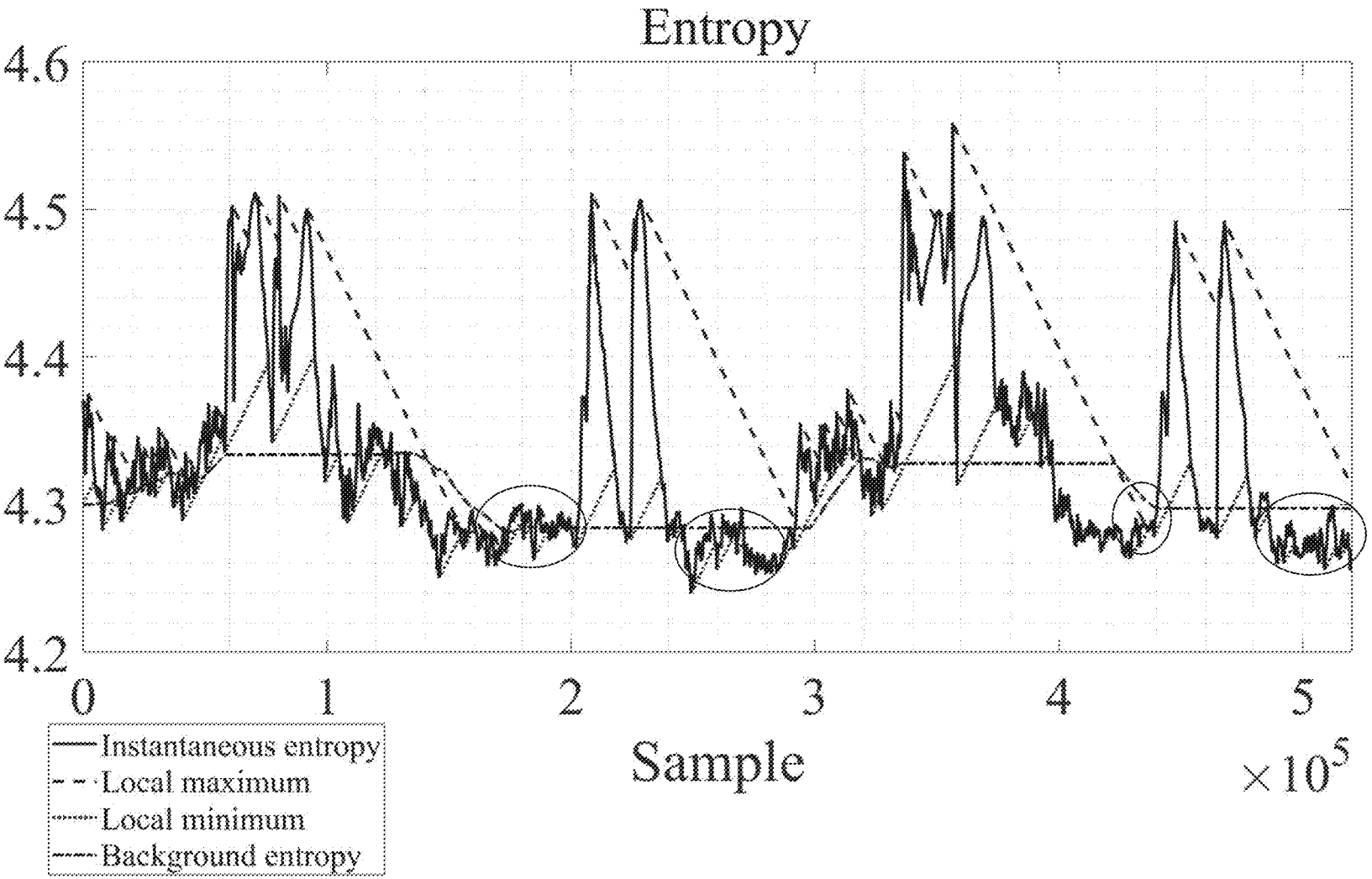
FIG. 6B depicts the instantaneous entropy, local minimum, local maximum and background entropy of the audio signal of FIG. 6A, calculated according to embodiments of the invention.
Figure 6C:
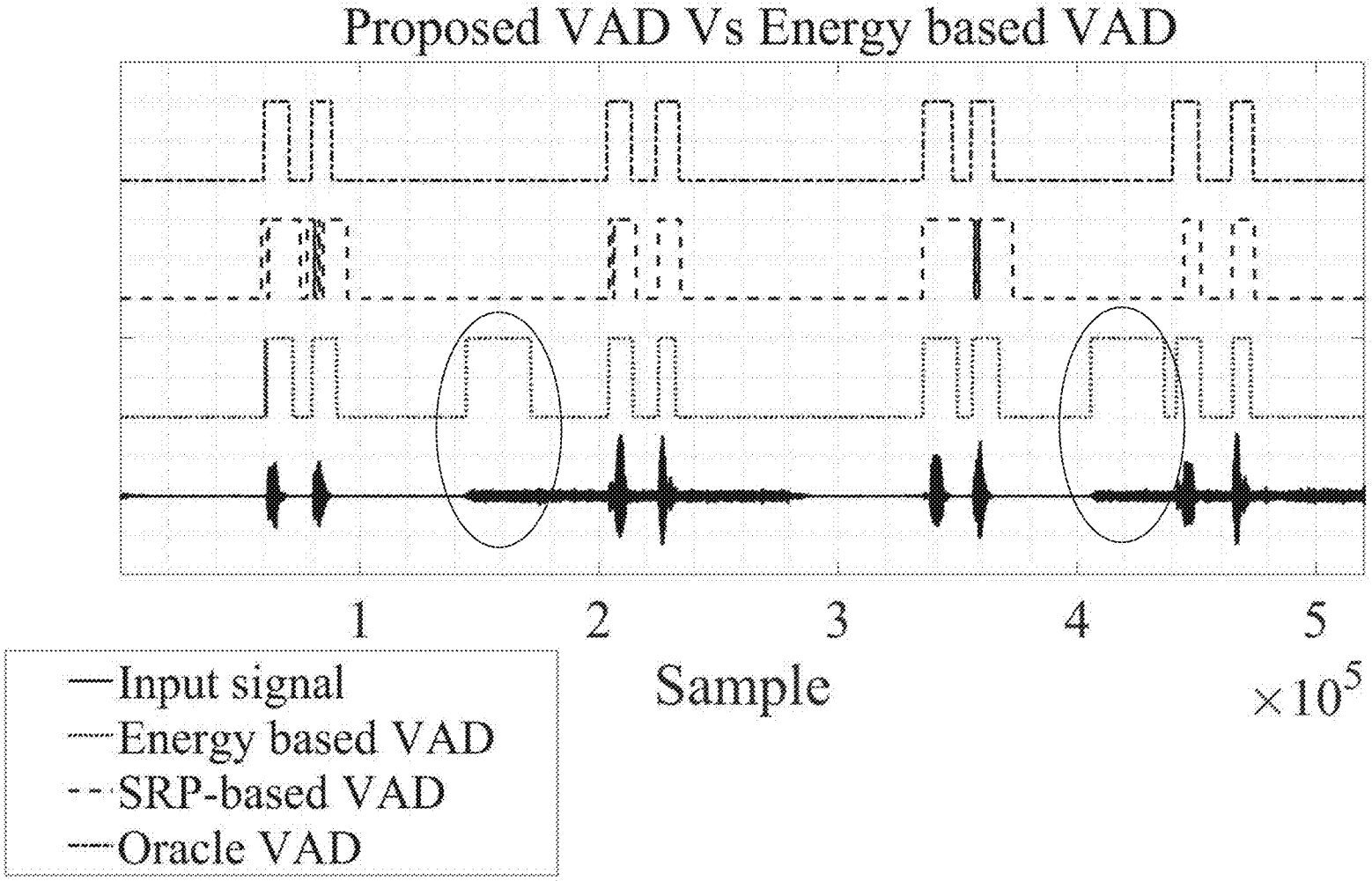
FIG. 6C depicts the audio signal of FIG. 6A, the energy based VAD, the SRP based VAD calculated according to embodiments of the invention and the oracle VAD of the audio signal.

FIGS. 6A-C depict experimental results for an experimental setup including a speaker and a directional noise source with fluctuating amplitude, according to some embodiments. The tested scenario included a directional noise source with a fluctuating level and a human speaker that was positioned in 90° (degrees) with respect to the noise source and the microphone array and who spoke isolated words. FIG. 6A depicts a sonogram, e.g., frequency distribution verses time. FIG. 6B depicts the instantaneous entropy, local minimum, local maximum and background entropy of the audio signal recorded by the microphone array, calculated according to embodiments of the invention. FIG. 6C depicts the input signal (the recorded audio signal), the energy-based VAD, the SRP-based VAD and the oracle VAD (e.g., the true speech activity). In the example depicted in FIG. 6C VAD values may be 0 (zero) for non-voiced samples or 1 (one) for voiced samples. Speech may be represented in the sonogram in FIG. 6A as horizontal lines 610, and noise may be represented as darker regions 920. It can clearly be seen that the energy-based VAD had two false alarm regions where the noise amplitude has increased (encircled in FIG. 6C); however, the SRP-based VAD did not respond to the variations in the noise amplitude. It can also be seen that the instantaneous entropy is close to the background entropy in noisy periods, even when the noise volume increased or decreased (encircled regions in FIG. 6B) and is differed during speech periods.

Figure 7A:
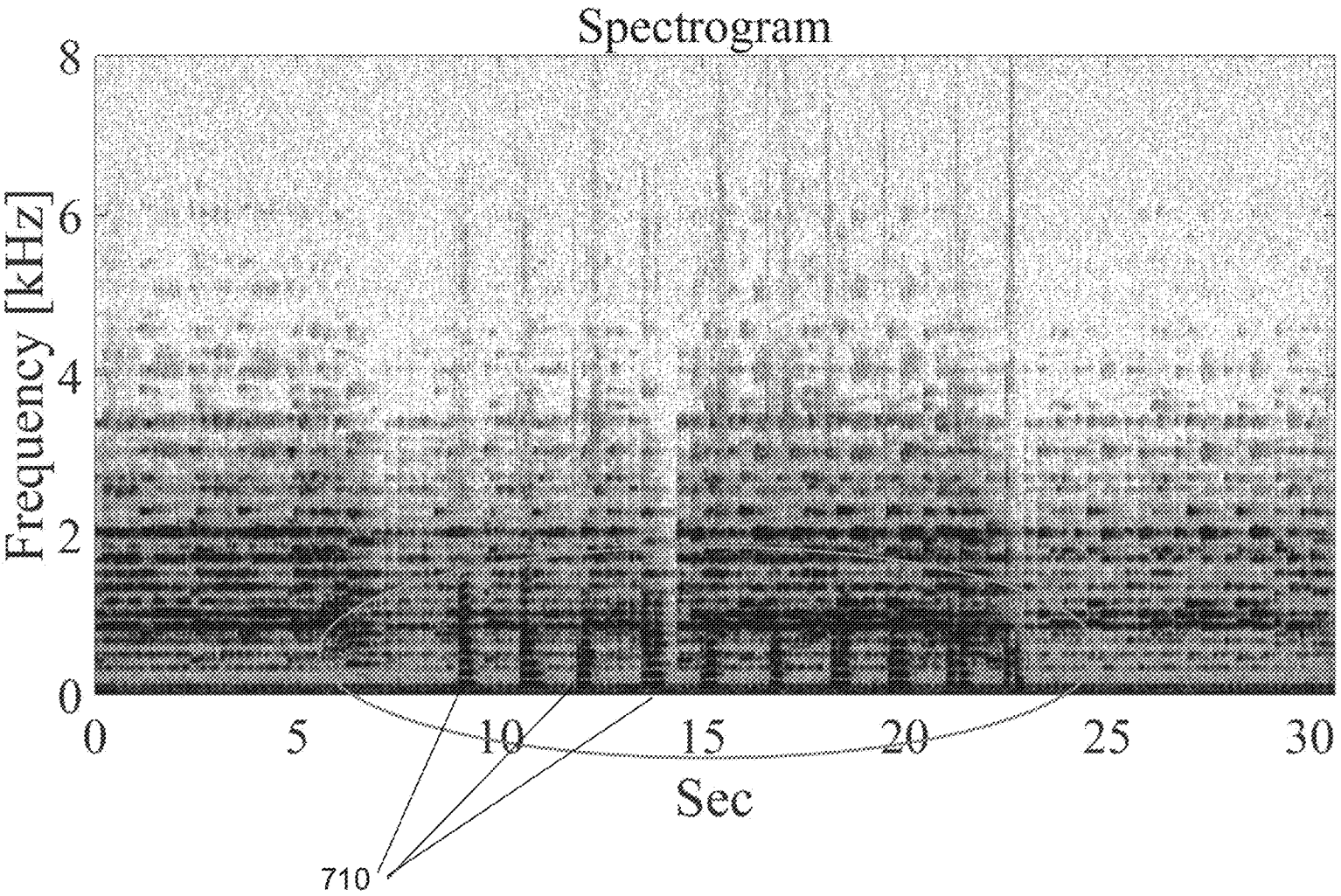
FIG. 7A depicts a sonogram of an audio signal recorded by a microphone array in an experimental setup including a speaker and a music source, which may be used with embodiments of the invention.
Figure 7B:
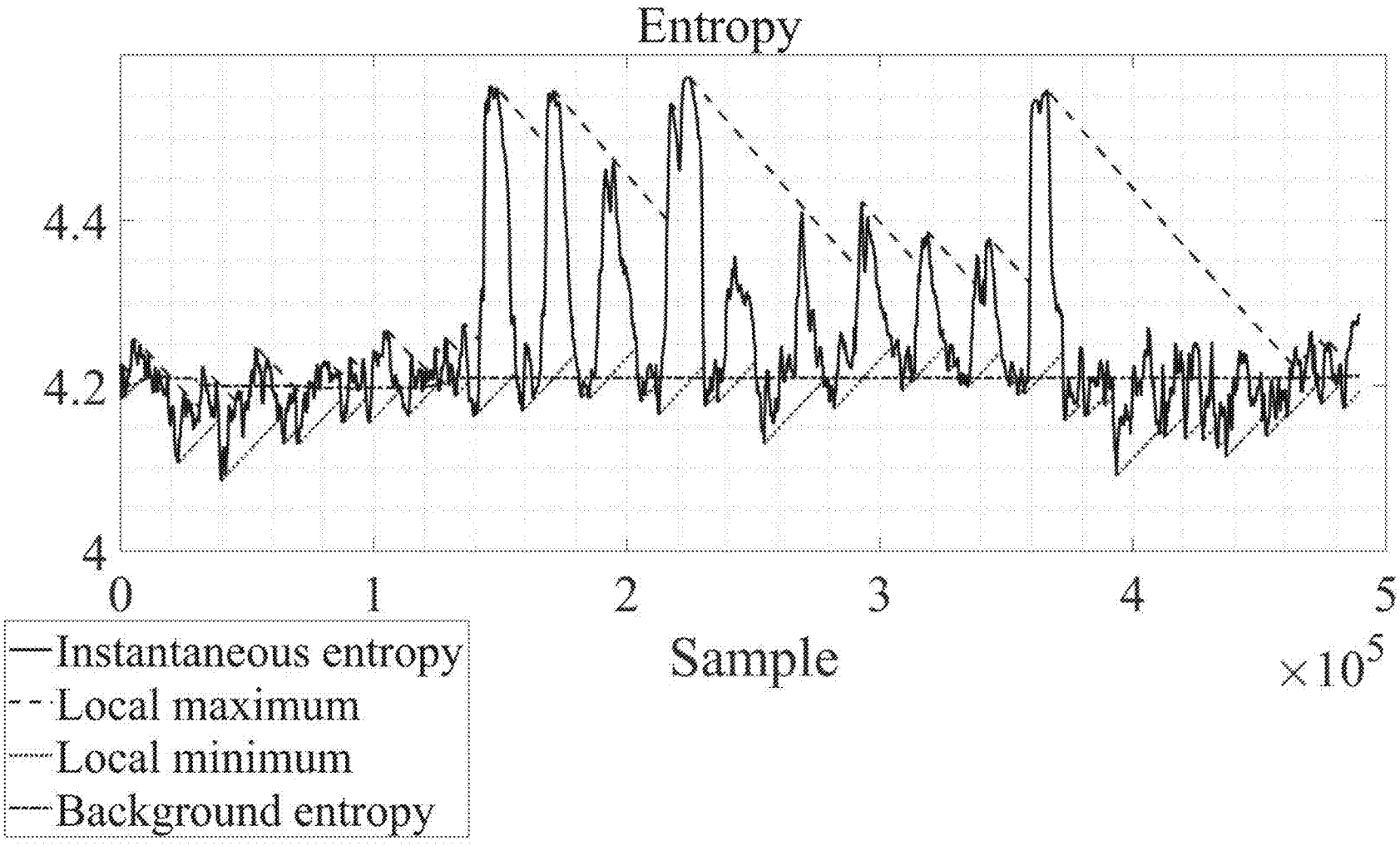
FIG. 7B depicts the instantaneous entropy, local minimum, local maximum and background entropy of the audio signal of FIG. 7A, calculated according to embodiments of the invention.
Figure 7C:
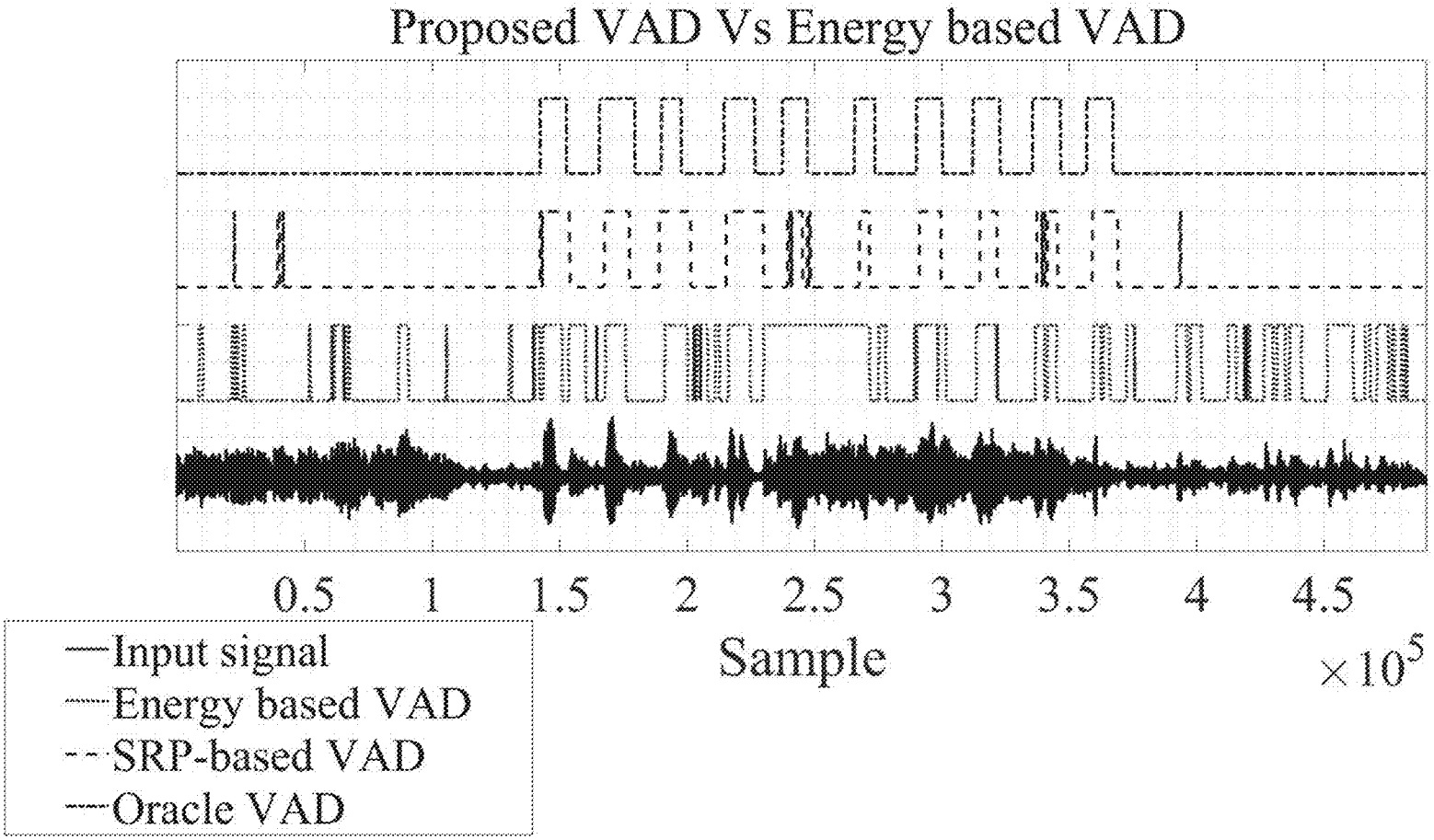
FIG. 7C depicts the audio signal of FIG. 7A, the energy based VAD, the SRP based VAD calculated according to embodiments of the invention and the oracle VAD of the audio signal.

FIGS. 7A-C depict experimental results for an experimental setup including a speaker and a music source, according to some embodiments. The tested scenario included a music source and a human speaker that was positioned in 90° (degrees) with respect to the noise source and the microphone array and who spoke isolated words. FIG. 7A depicts a sonogram. FIG. 7B depicts the instantaneous entropy, local minimum, local maximum and background entropy of the audio signal recorded by the microphone array and calculated according to embodiments of the invention. FIG. 7C depicts the input signal (the recorded audio signal), the energy-based VAD, the SRP-based VAD and the oracle VAD (e.g., the true speech activity). In the example depicted in FIG. 7C VAD values may be zero for non-voiced samples or one for voiced samples. Speech may be represented in the sonogram in FIG. 7A as horizontal lines 710 that are present in the encircled area. It can be seen that in this case the energy-based VAD failed completely, since the energy of the music was highly time-varying. In contrast, the SRP-based VAD was relatively successful in detecting speech since the directionality of the music frames was almost constant and significantly changed only when the speaker was also active.

Figure 8A:
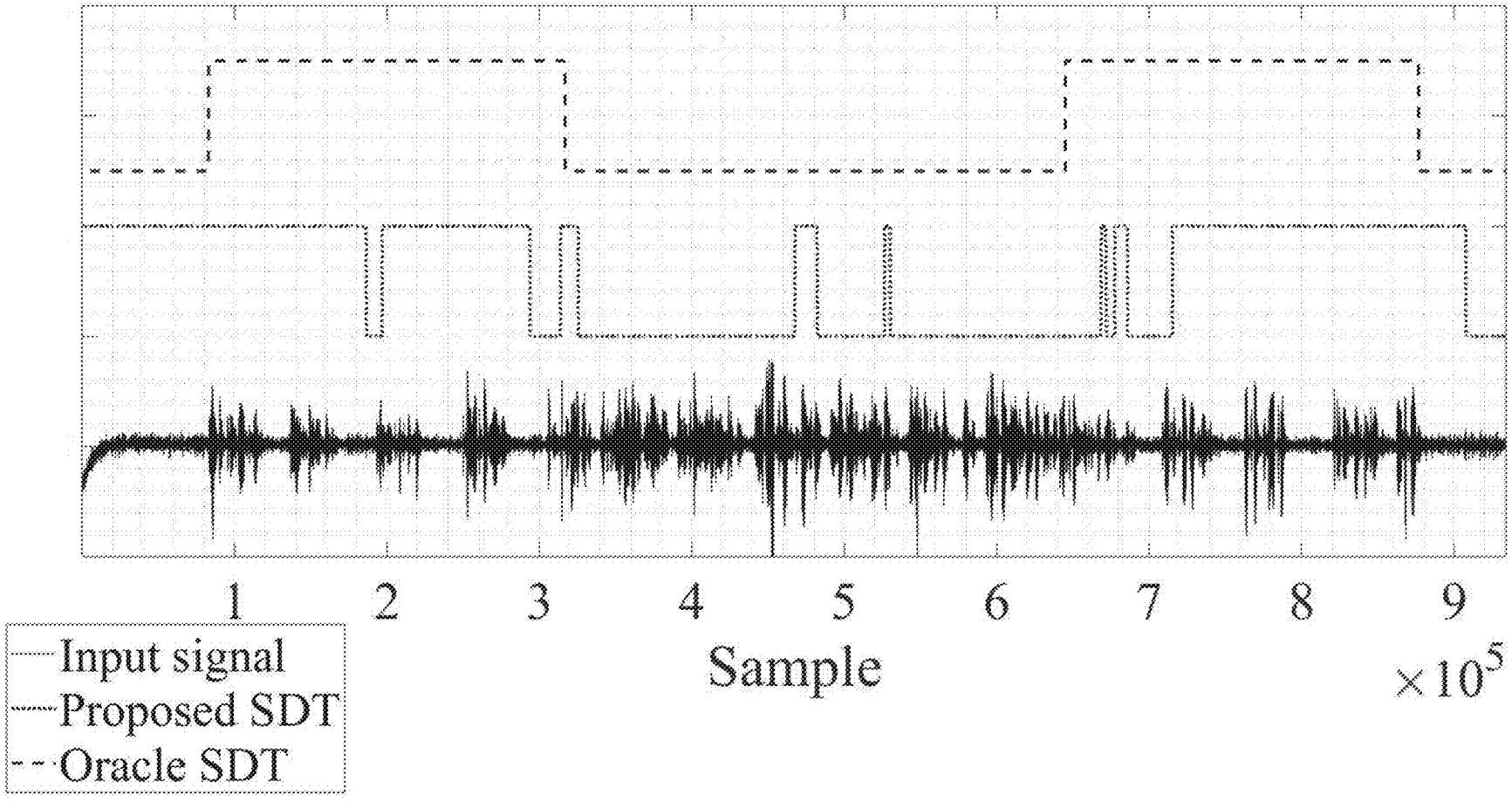
FIG. 8A depicts an audio signal recorded by a microphone array in an experimental setup including two speakers in noiseless background, together the entropy-based STD, and the oracle STD of the recorded audio signal, which may be used with embodiments of the invention.
Figure 8B:
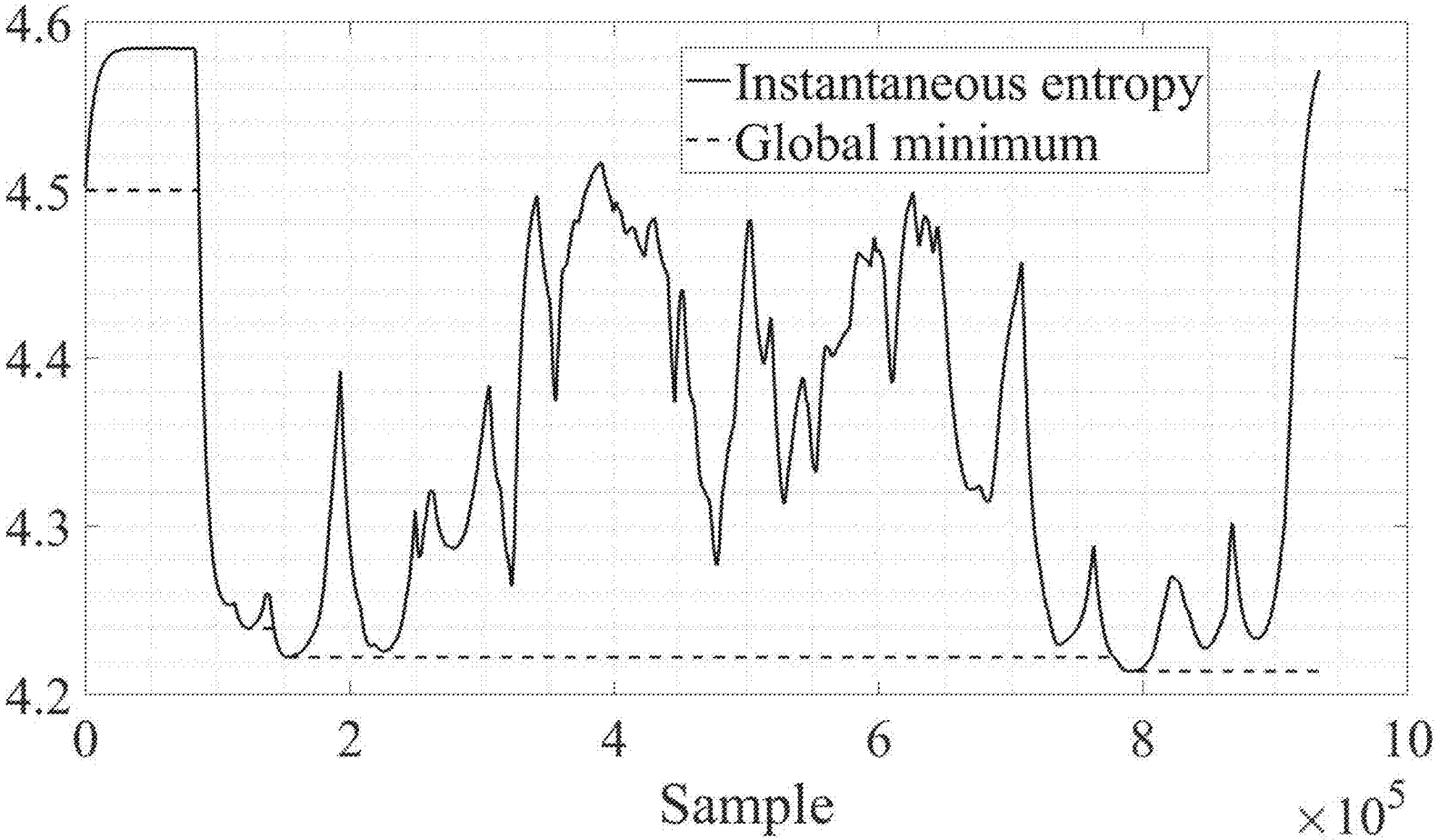
FIG. 8B depicts the instantaneous entropy and the the global minimum of the entropy estimation of the audio signal of FIG. 8A.

For examining the entropy-based STD, two speakers were recorded with a single and a double talk sections in noiseless background. The speakers were placed 1 meter from the microphone array with 180° between them. In FIG. 8A depicts the input audio signal (the recorded audio signal), the entropy-based STD, and the oracle STD (e.g., the true STD). STD values are 0 (zero, more than one speaker) or 1 (one, single speaker). FIG. 8B depicts the instantaneous entropy and the global minimum of the entropy estimation. It can be seen that the single talk sections are well detected relatively to the oracle single talk sections.

Figure 9:
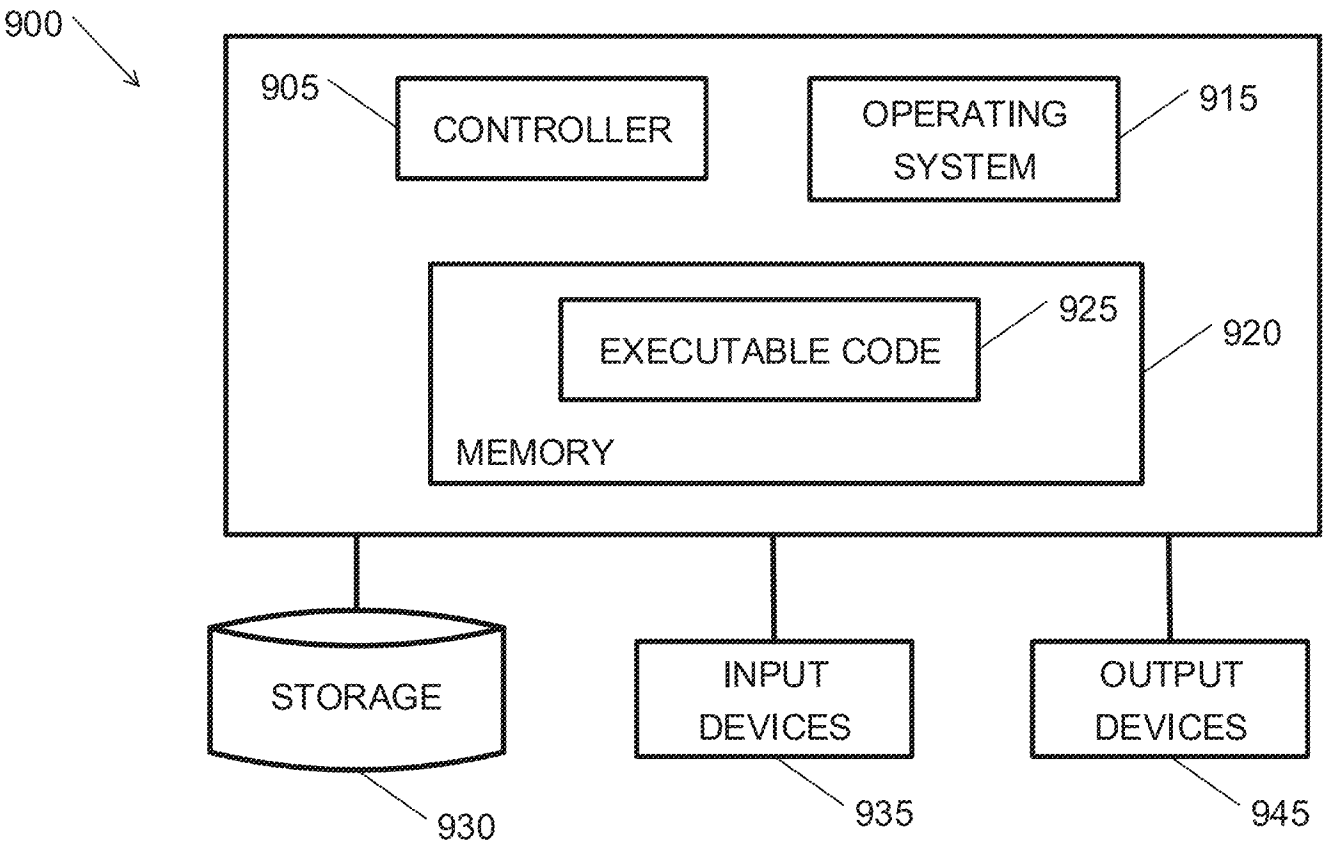
FIG. 9 is a high-level block diagram of an exemplary computing device according to some embodiments of the present invention.

Reference is made to FIG. 9, showing a high-level block diagram of an exemplary computing device according to some embodiments of the present invention. Computing device 900 may include a processor or controller 905 that may be, for example, a central processing unit processor (CPU), a graphics processing unit (GPU), a chip or any suitable computing or computational device, an operating system 915, a memory 920, executable code 925, storage or storage device 930, input devices 935 and output devices 945. Controller 905 may be configured to carry out methods described herein, and/or to execute or act as the various modules, units, etc., for example by executing code or software. More than one computing device 900 may be included. Micro-services, engines, processes, and other modules described herein may be for example software executed (e.g., as programs, applications or instantiated processes, or in another manner) by one or more controllers 905. Multiple processes discussed herein may be executed on the same controller. For example, VAD and STD unit 140, SRP calculation unit 120, BF unit 130, and ASR unit 150 presented in FIG. 1 may be implemented by one or more controllers 905.

Operating system 915 may be or may include any code segment (e.g., one similar to executable code 925 described herein) designed and/or configured to perform tasks involving coordination, scheduling, arbitration, supervising, controlling or otherwise managing operation of computing device 900, for example, scheduling execution of software programs or enabling software programs or other modules or units to communicate. Operating system 915 may be a commercial operating system.

Memory 920 may be or may include, for example, a Random Access Memory (RAM), a read only memory (ROM), a Dynamic RAM (DRAM), a Synchronous DRAM (SD-RAM), a double data rate (DDR) memory chip, a Flash memory, a volatile memory, a non-volatile memory, a cache memory, a buffer, a short term memory unit, a long term memory unit, or other suitable memory units or storage units. Memory 920 may be or may include a plurality of, possibly different memory units. Memory 920 may be a computer or processor non-transitory readable medium, or a computer non-transitory storage medium. e.g., a RAM.

Executable code 925 may be any executable code, e.g., an application, a program, a process, task or script. Executable code 925 may be executed by controller 905 possibly under control of operating system 915. For example, executable code 925 may be an application that when executed performs VAD and STD as further described herein. Although, for the sake of clarity, a single item of executable code 925 is shown in FIG. 9, a system according to embodiments of the invention may include a plurality of executable code segments similar to executable code 925 that may be loaded into memory 920 and cause controller 905 to carry out methods described herein. For example, units or modules described herein may be, or may include, controller 905 and executable code 925.

Storage device 930 may be any applicable storage system, e.g., a disk or a virtual disk used by a VM. Storage 930 may be or may include, for example, a hard disk drive, a floppy disk drive, a Compact Disk (CD) drive, a CD-Recordable (CD-R) drive, a Blu-ray disk (BD), a universal serial bus (USB) device or other suitable removable and/or fixed storage unit. Content or data may be stored in storage 930 and may be loaded from storage 930 into memory 920 where it may be processed by controller 905. In some embodiments, some of the components shown in FIG. 9 may be omitted. For example, memory 920 may be a non-volatile memory having the storage capacity of storage 930. Accordingly, although shown as a separate component, storage 930 may be embedded or included in memory 920.

Input devices 935 may be or may include microphones, a mouse, a keyboard, a touch screen or pad or any suitable input device. It will be recognized that any suitable number of input devices may be operatively connected to computing device 900 as shown by block 935. Output devices 945 may include one or more displays or monitors, speakers and/or any other suitable output devices. It will be recognized that any suitable number of output devices may be operatively connected to computing device 900 as shown by block 945. Any applicable input/output (I/O) devices may be connected to computing device 900 as shown by input devices 935 and output devices 945. For example, a wired or wireless network interface card (NIC), a printer, a universal serial bus (USB) device or external hard drive may be included in input devices 935 and/or output devices 945.

Some embodiments of the invention may include an article such as a computer or processor non-transitory readable medium, or a computer or processor non-transitory storage medium, such as for example a memory, a disk drive, or a USB flash memory, encoding, including or storing instructions, e.g., computer-executable instructions, which, when executed by a processor or controller, carry out methods disclosed herein. For example, an article may include a storage medium such as memory 920, computer-executable instructions such as executable code 925 and a controller such as controller 905.

The storage medium may include, but is not limited to, any type of disk including, semiconductor devices such as read-only memories (ROMs) and/or random access memories (RAMs), flash memories, electrically erasable programmable read-only memories (EEPROMs) or any type of media suitable for storing electronic instructions, including programmable storage devices. For example, in some embodiments, memory 920 is a non-transitory machine-readable medium.

A system according to some embodiments of the invention may include components such as, but not limited to, a plurality of central processing units (CPU) or any other suitable multi-purpose or specific processors or controllers (e.g., controllers similar to controller 905), a plurality of input units, a plurality of output units, a plurality of memory units, and a plurality of storage units. A system according to some embodiments of the invention may additionally include other suitable hardware components and/or software components. In some embodiments, a system may include or may be, for example, a personal computer, a desktop computer, a laptop computer, a workstation, a server computer, a network device, or any other suitable computing device. For example, a system according to some embodiments of the invention as described herein may include one or more devices such as computing device 900.

Different embodiments are disclosed herein. Features of certain embodiments may be combined with features of other embodiments; thus certain embodiments may be combinations of features of multiple embodiments.

Embodiments of the invention may include an article such as a computer or processor readable non-transitory storage medium, such as for example a memory, a disk drive, or a USB flash memory device encoding, including or storing instructions, e.g., computer-executable instructions, which when executed by a processor or controller, cause the processor or controller to carry out methods disclosed herein.

While the invention has been described with respect to a limited number of embodiments, these should not be construed as limitations on the scope of the invention, but rather as exemplifications of some of the preferred embodiments. Other possible variations, modifications, and applications are also within the scope of the invention. Different embodiments are disclosed herein. Features of certain embodiments may be combined with features of other embodiments; thus certain embodiments may be combinations of features of multiple embodiments.

What is claimed is:

1. A method for voice activity detection (VAD) comprising:

obtaining audio frames from a multi-microphone array;

calculating steered response power (SRP) values of the audio frames;

calculating entropy levels of the SRP values; and determining whether an incoming audio frame contains voice activity based on the entropy levels, wherein determining whether an incoming audio frame contains voice activity comprises:

detecting a sequence of audio frames in which the entropy levels are substantially constant across the sequence of frames and denoting an entropy level of the sequence as a background entropy; and identifying an incoming audio frame as containing voice activity if the difference between a level of entropy of the incoming audio frame and the background entropy is larger than a first threshold, and as not containing voice activity otherwise.

2. The method of claim 1, wherein detecting the sequence of audio frames in which entropy levels are substantially constant comprises:

for an incoming audio frame:

finding a local minimum entropy level of the audio frames;

finding a local maximum entropy level of the audio frames; and determining that the entropy levels of the set of audio frames are substantially constant if the difference between the local minimum entropy level and the local maximum entropy level is below a second threshold.

3. The method of claim 2, wherein, for a set of audio frames:

finding the local minimum entropy level comprises selecting the minimal value between the entropy level of an incoming audio frame and the previous local minimum entropy level determined for an audio frame previous to the incoming audio frame; and finding the local maximum entropy level comprises selecting the maximum value between the entropy level of an incoming audio frame and the previous local maximum entropy level determined for an audio frame previous to the incoming audio frame.

4. The method of claim 3, wherein one of the previous local minimum entropy level and the selected minimal value is multiplied by a value larger than one, and wherein one of the previous local maximum entropy level and the selected maximum value is multiplied by a value smaller than one.

5. The method of claim 1, comprising performing single talk detection (STD) based on the entropy levels.

6. The method of claim 1, comprising:

determining a global minimum of the entropy by finding a minimal value of the entropy levels in a predetermined time frame;

determining that an audio frame contains speech originated from a single speaker if the difference between the level of entropy of the audio frame and the global minimum of the entropy is larger than a threshold; and determining that an audio frame contains speech originated from more than one speaker otherwise.

7. The method of claim 1, comprising performing noise cancelation by:

characterizing noise parameters based on audio frames that do not contain voice activity; and using the noise parameters for performing noise cancelation.

8. A method for speech recognition, comprising:

obtaining audio frames sampled by a multi-microphone array;

providing a vector of steered response power (SRP) values based on the audio frames, wherein each SRP value provides a probability of a speaker to be in a direction associated with the SRP value;

calculating instantaneous entropy levels of the SRP values; and performing voice activity detection (VAD) of the audio frames based on the entropy levels, wherein performing VAD comprises:

detecting a sequence of audio frames in which the entropy levels are substantially constant across the sequence of frames and denoting an entropy level of the sequence as a background entropy; and identifying a current audio frame as containing voice activity if the difference between a level of entropy of the current audio frame and the background entropy is larger than a first threshold, and as not containing voice activity otherwise.

9. The method of claim 8, comprising performing noise cancelation by:

characterizing noise parameters based on audio frames that do not contain voice activity; and using the noise parameters for performing noise cancelation.

10. The method of claim 8, comprising performing single talk detection (STD) based on the entropy levels.

11. A system for voice activity detection (VAD), the system comprising:

a memory;

a processor configured to:

obtain audio frames from a multi-microphone array;

calculate steered response power (SRP) values of the audio frames;

calculate entropy levels of the SRP values; and determine whether an incoming audio frame contains voice activity based on the entropy levels k:

detecting a sequence of audio frames in which the entropy levels are substantially constant across the sequence of frames and denoting an entropy level of the sequence as a background entropy; and identifying an incoming audio frame as containing voice activity if the difference between a level of entropy of the current audio frame and the background entropy is larger than a first threshold, and as not containing voice activity otherwise.

12. The system of claim 11, wherein the processor is configured to detect the sequence of audio frames in which entropy levels are substantially constant by:

for an incoming audio frame:

finding a local minimum entropy level of the audio frames;

finding a local maximum entropy level of the audio frames; and determining that the entropy levels of the set of audio frames are substantially constant if the difference between the local minimum entropy level and the local maximum entropy level is below a second threshold.

13. The system of claim 12, wherein, for a set of audio frames, the processor is configured to:

find the local minimum entropy level by selecting the minimal value between the entropy level of an incoming audio frame and the previous local minimum entropy level determined for an audio frame previous to the incoming audio frame, and find the local maximum entropy level by selecting the maximum value between the entropy level of an incoming audio frame and the previous local maximum entropy level determined for an audio frame previous to the incoming audio frame.

14. The system of claim 13, wherein the processor is configured to multiply one of the previous local minimum entropy level and the selected minimal value by a value larger than one, and to multiply one of the previous local maximum entropy level and the selected maximum value by a value smaller than one.

15. The system of claim 11, wherein the processor is configured to perform single talk detection (STD) based on the entropy levels.

16. The system of claim 11, wherein the processor is configured to:

determine a global minimum of the entropy by finding a minimal value of the entropy levels in a predetermined time frame;

determine that an audio frame contains speech originated from a single speaker if the difference between the level of entropy of the audio frame and the global minimum of the entropy is larger than a threshold; and determine that an audio frame contains speech originated from more than one speaker otherwise.

17. The system of claim 11, wherein the processor is configured to perform noise cancelation by:

characterizing noise parameters based on audio frames that do not contain voice activity; and using the noise parameters for performing noise cancellation.

* * * * *